US009804536B2

(12) United States Patent
Matsushita

(10) Patent No.: US 9,804,536 B2
(45) Date of Patent: Oct. 31, 2017

(54) IMAGE FORMING APPARATUS

(71) Applicant: FUJI XEROX CO., LTD., Tokyo (JP)

(72) Inventor: Kaoru Matsushita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/139,997

(22) Filed: Apr. 27, 2016

(65) Prior Publication Data

US 2017/0185006 A1 Jun. 29, 2017

(30) Foreign Application Priority Data

Dec. 24, 2015 (JP) ..... 2015-251333

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS

2010/0080597 A1* 4/2010 Seki ..... G03G 15/0194 399/66
2010/0266305 A1* 10/2010 Yanagi ..... G03G 15/0131 399/68
2015/0063879 A1* 3/2015 Yuasa ..... G03G 15/0136 399/302
2015/0338790 A1* 11/2015 Makino ..... G03G 15/1615 399/299
2015/0363677 A1* 12/2015 Nihei ..... G03G 15/0131 358/1.12

FOREIGN PATENT DOCUMENTS

JP 2007-057652 A 3/2007
JP 2007-093782 A 4/2007

* cited by examiner

*Primary Examiner* — Francis Gray
(74) *Attorney, Agent, or Firm* — Oliff PLC

(57) ABSTRACT

An image forming apparatus includes an endless belt that is stretched around plural rollers; a driving unit that drives the belt to rotate; a contact member that is in contact with a part of a surface of the belt, the part being supported by one of the plural rollers; and a switching device that changes an image forming mode by displacing at least one of the plural rollers. When the image forming mode is changed by the switching device, the belt is rotated by the driving unit in a normal direction at a speed higher than a speed of reverse rotation of the roller that is in contact with the contact member with the belt interposed therebetween.

6 Claims, 24 Drawing Sheets

FIG. 15A
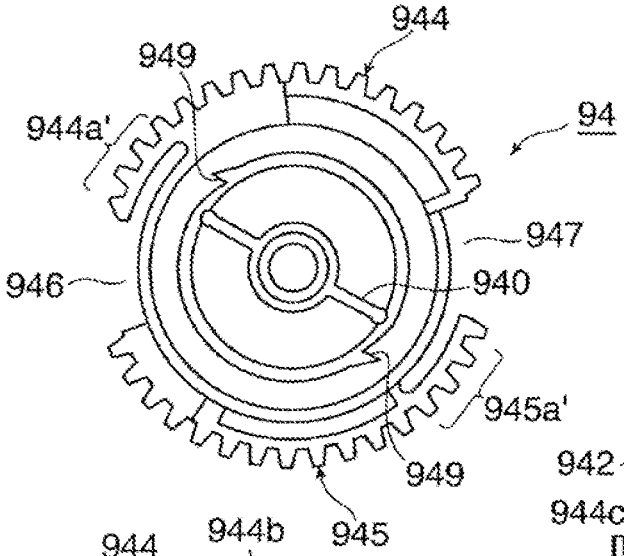
FIG. 15B
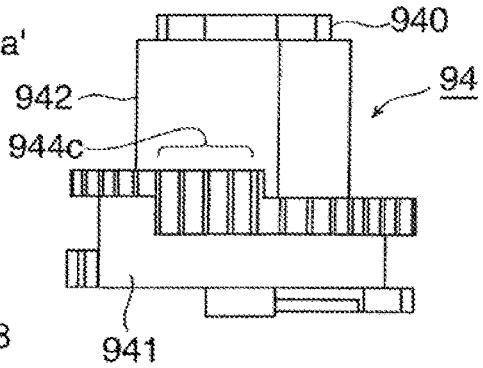
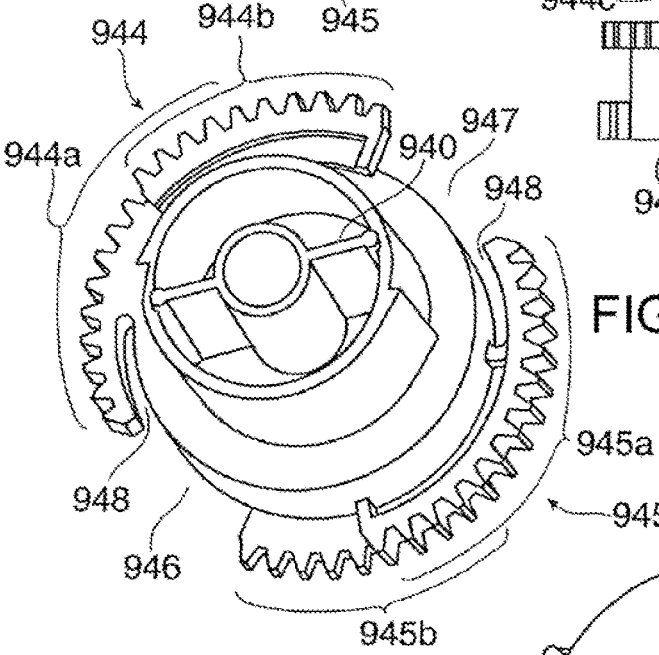
FIG. 15C
FIG. 15D
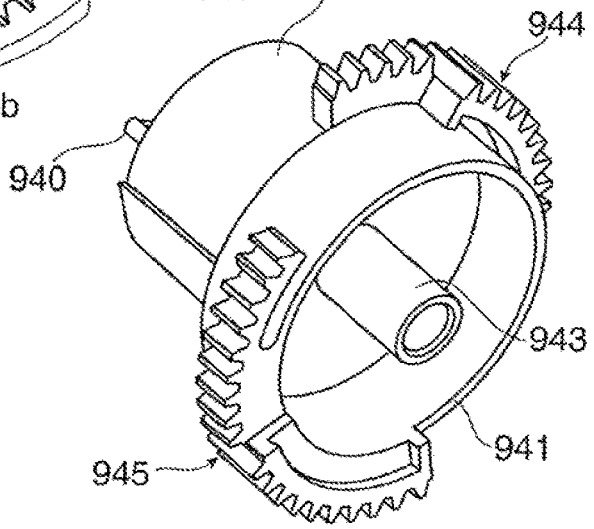

IMAGE FORMING APPARATUS

CROSS-REFERENCE TO RELATED APPLICATIONS

This application is based on and claims priority under 35 USC 119 from Japanese Patent Application No. 2015-251333 filed Dec. 24, 2015.

BACKGROUND (i) Technical Field

The present invention relates to an image forming apparatus.

(ii) Related Art

In some related-art image forming apparatuses, when the operation mode is changed from a full-color mode to a monochrome mode, some of plural rollers around which an intermediate transfer belt is stretched are moved.

SUMMARY

According to an aspect of the invention, there is provided an image forming apparatus including an endless belt that is stretched around plural rollers; a driving unit that drives the belt to rotate; a contact member that is in contact with a part of a surface of the belt, the part being supported by one of the plural rollers; and a switching device that changes an image forming mode by displacing at least one of the plural rollers. When the image forming mode is changed by the switching device, the belt is rotated by the driving unit in a normal direction at a speed higher than a speed of reverse rotation of the roller that is in contact with the contact member with the belt interposed therebetween.

BRIEF DESCRIPTION OF THE DRAWINGS

An exemplary embodiment of the present invention will be described in detail based on the following figures, wherein:

FIGS. 15A to 15D are perspective views of a partially toothless gear;

DETAILED DESCRIPTION

Figure 1:
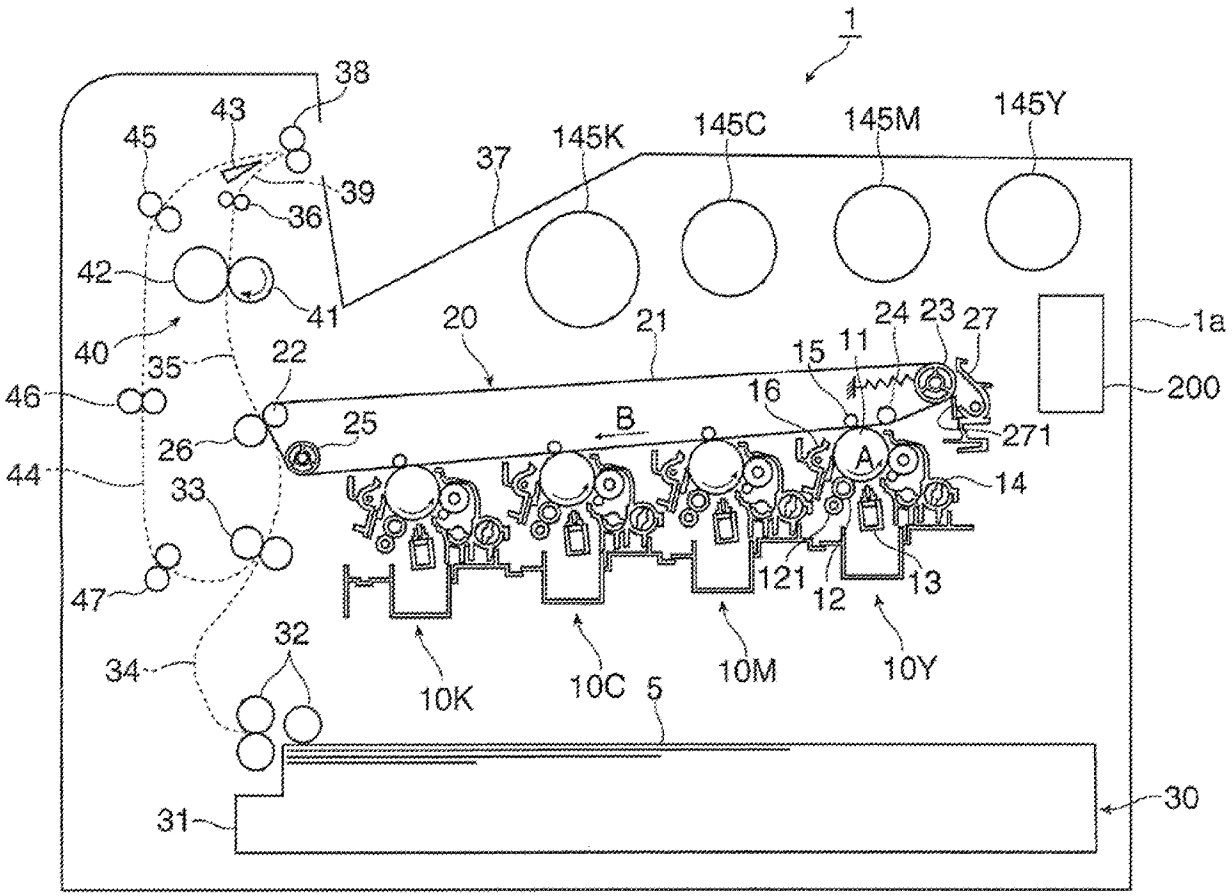
FIG. 1 illustrates an overall configuration of an image forming apparatus according to the exemplary embodiment of the present invention.
Figure 2:
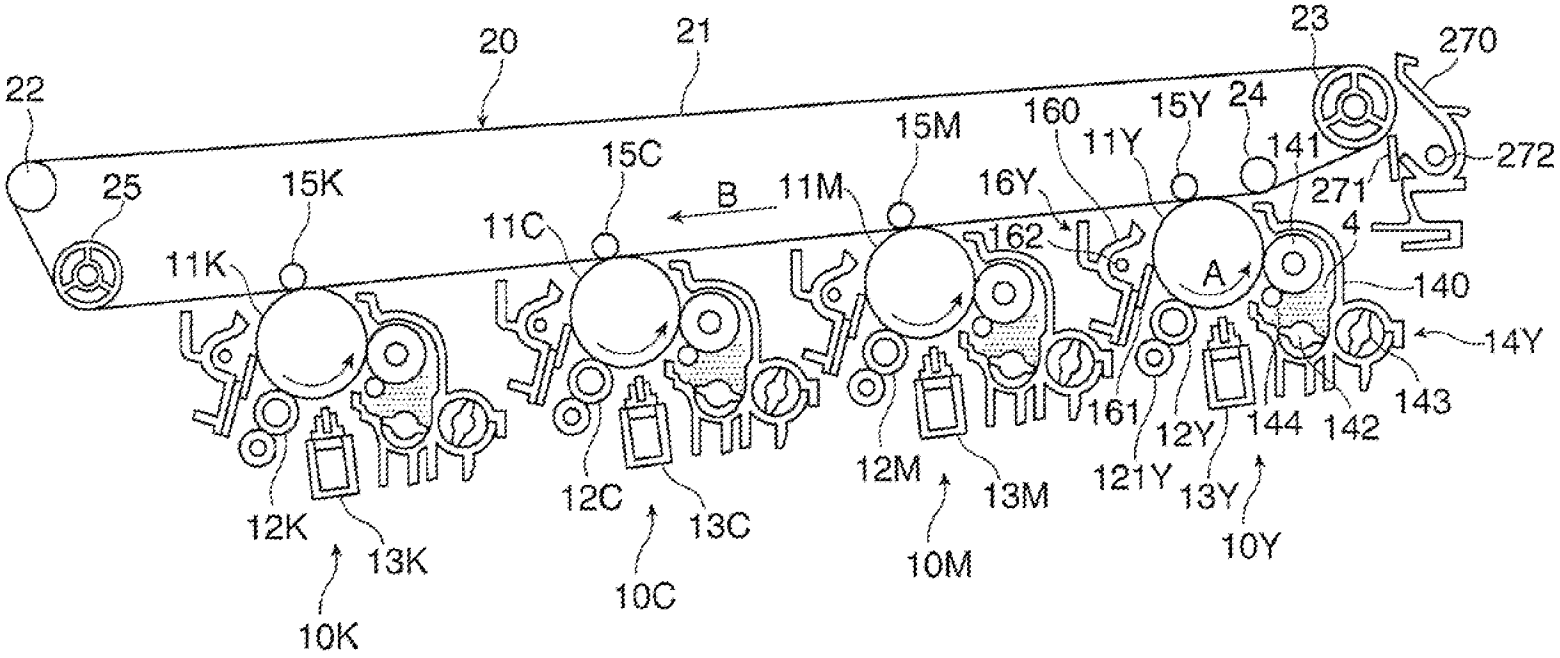
FIG. 2 illustrates an image forming section of the image forming apparatus according to the exemplary embodiment of the present invention.

FIGS. 1 and 2 illustrate an image forming apparatus 1 according to an exemplary embodiment of the present invention. FIG. 1 illustrates the outline of the image forming apparatus 1. FIG. 2 is an enlargement of relevant elements (image forming devices and so forth) of the image forming apparatus 1.

Outline of Image Forming Apparatus

The image forming apparatus 1 according to the present exemplary embodiment is, for example, a color printer. The image forming apparatus 1 includes plural image forming devices 10 that form respective toner images each composed of a toner contained in a developer 4, an intermediate transfer device 20 that carries the toner images formed by the image forming devices 10 and transports the toner images eventually to a second transfer position where the toner images are transferred to a piece of recording paper 5 as an exemplary recording medium in second transfer, a paper feeding device 30 that contains desired pieces of recording paper 5 to be fed to the second transfer position defined in the intermediate transfer device 20 and feeds each piece of recording paper 5 to the second transfer position, a fixing device 40 that fixes the toner images transferred to the piece of recording paper 5 in the second transfer by the intermediate transfer device 20, and other associated elements. The image forming apparatus 1 has an apparatus body 1*a* that is formed of structural supporting members, an exterior covering, and so forth. Broken lines in FIG. 1 represent transport paths along which the piece of recording paper 5 is transported in the apparatus body 1*a*.

There are four image forming devices 10: namely, image forming devices 10Y, 10M, 10C, and 10K that each exclusively form a toner image in a corresponding one of four respective colors of yellow (Y), magenta (M), cyan (C), and black (K). The four image forming devices 10 (Y, M, C, and K) are arranged in a line inclined in the internal space of the apparatus body 1*a*.

The four image forming devices 10 are grouped into color image forming devices 10 (Y, M, and C) for yellow (Y), magenta (M), and cyan (C) and the image forming device 10K for black (K). The black image forming device 10K is positioned on the extreme end on the downstream side in a direction of rotation, indicated by an arrow B, of an intermediate transfer belt 21 included in the intermediate transfer device 20. The image forming apparatus 1 has two image forming modes: namely, a full-color mode in which a full-color image is formed by activating the color image forming devices 10 (Y, M, and C) and the black image forming device 10K, and a monochrome mode in which a black-and-white image (monochrome image) is formed by activating only the black image forming device 10K.

As illustrated in FIGS. 1 and 2, the image forming devices 10 (Y, M, C, and K) each include a rotatable photoconductor drum 11 as an exemplary image carrier. The photoconductor drum 11 is surrounded by associated devices, which are exemplary toner-image-forming devices: namely, a charging device 12 that charges the peripheral surface (image carrying surface) of the photoconductor drum 11 on which an image is to be formed to a predetermined potential, an exposure device 13 that applies light generated on the basis of image information (a signal) to the charged peripheral surface of the photoconductor drum 11 and thus forms an electrostatic latent image (for a corresponding one of the above colors) by utilizing a potential difference, a developing device 14 (Y, M, C, or K) that develops the electrostatic latent image with the toner contained in the developer 4 for a corresponding one of the colors (Y, M, C, and K) and thus forms a toner image, a first transfer device 15 (Y, M, C, or K) as an exemplary first transfer unit that transfers the toner image to the intermediate transfer device 20, a drum cleaning device 16 (Y, M, C, or K) that removes unwanted substances, such as toner particles, remaining on the image carrying surface of the photoconductor drum 11 from the photoconductor drum 11 having undergone the first transfer, and other associated devices.

The photoconductor drum 11 includes a cylindrical or columnar base member that is grounded, and a photoconductive (photosensitive) layer made of a photosensitive material and provided over the peripheral surface of the base member. The photoconductive layer forms the image carrying surface. The photoconductor drum 11 is supported in such a manner as to rotate in a direction of an arrow A when a driving force is transmitted thereto from a driving device (not illustrated).

The charging device 12 includes a contact-type charging roller provided in contact with the photoconductor drum 11, and a cleaning roller 121 that cleans the surface of the charging roller. A charging voltage is applied to the charging device 12. If the developing device 14 is configured to perform reversal development, a charging voltage (or current) of the same polarity as the polarity with which the toner supplied from the developing device 14 to the photoconductor drum 11 is charged is applied to the charging device 12. The charging device 12 may be of a non-contact type, such as a scorotron, provided out of contact with the surface of the photoconductor drum 11.

The exposure device 13 is a light-emitting-diode (LED) printhead including plural LEDs as light-emitting elements aligned in the axial direction of the photoconductor drum 11, and forms an electrostatic latent image on the photoconductor drum 11 by applying light thereto on the basis of the image information. The exposure device 13 may be another device that applies a laser beam generated on the basis of the image information to the photoconductor drum 11 while scanningly moving in the axial direction of the photoconductor drum 11.

Referring to FIG. 2, the developing device 14 (Y, M, C, or K) includes a housing 140 having an opening and a chamber in which the developer 4 is contained. The housing 140 houses a developing roller 141 that carries and transports the developer 4 to a development area facing the photoconductor drum 11, two stirring-and-transporting members 142 and 143 such as screw augers that stir and transport the developer 4 such that the developer 4 is delivered to the developing roller 141, a layer-thickness-regulating member 144 that regulates the amount (thickness of a layer) of developer 4 carried by the developing roller 141, and other associated elements. A development voltage is applied between the developing roller 141 of the developing device 14 and the photoconductor drum 11 from a power supply device (not illustrated). The developing roller 141 and the stirring-and-transporting members 142 and 143 rotate in respective predetermined directions when a driving force is transmitted thereto from a driving device (not illustrated). The developer 4 for a corresponding one of the four colors (Y, M, C, and K) is a two-component developer composed of a non-magnetic toner and a magnetic carrier.

The first transfer device 15 (Y, M, C, or K) is rotatable while being in contact with the peripheral surface of the photoconductor drum 11 with the intermediate transfer belt 21 interposed therebetween. The first transfer device 15 is a contact-type transfer device that includes a first transfer roller to which a first transfer voltage is applied. A direct-current voltage of the polarity opposite to the polarity with which the toner is charge is applied as the first transfer voltage to the first transfer roller from a power supply device (not illustrated).

Referring to FIG. 2, the drum cleaning device 16 (Y, M, C, or K) includes a body 160 as a casing having an opening, a cleaning plate 161 that is pressed against the peripheral surface of the photoconductor drum 11 having undergone the first transfer with a predetermined pressure and thus removes unwanted substances such as residual toner particles from the photoconductor drum 11, a delivering member 162 such as a screw auger that collects the unwanted substances such as toner particles removed by the cleaning plate 161 and delivers the substances to a collecting system (not illustrated), and other associated elements. The cleaning plate 161 is a plate-like member (for example, a blade) made of rubber or the like.

Referring to FIG. 1, the intermediate transfer device 20 is provided above the image forming devices 10 (Y, M, C, and K). The intermediate transfer device 20 basically includes the intermediate transfer belt 21 that runs through first transfer positions each defined between a corresponding one of the photoconductor drums 11 and a corresponding one of the first transfer devices (first transfer rollers) 15 and rotates in the direction of the arrow B, plural belt supporting rollers 22 to 25 that retain the intermediate transfer belt 21 in a desired state from the inner side of the intermediate transfer belt 21 while allowing the intermediate transfer belt 21 to rotate, a second transfer device 26 as an exemplary second transfer unit provided in contact with a part of the outer surface (an image carrying surface) of the intermediate transfer belt 21 that is supported by the belt supporting roller 22, the second transfer device 26 transferring the toner images on the intermediate transfer belt 21 to a piece of recording paper 5 in the second transfer, and a belt cleaning device 27 that removes unwanted substances such as toner particles and paper lint remaining on the outer surface of the intermediate transfer belt 21 having passed the second transfer device 26.

The intermediate transfer belt 21 is an endless belt made of, for example, a material containing a synthetic resin, such as polyimide resin or polyamide resin, in which a resistance adjusting agent, such as carbon black, or the like agent is dispersed. The belt supporting roller 22 serves as a driving roller that is driven to rotate by a driving device (not illustrated). The driving roller 22 also serves as a backup roller in the second transfer. The belt supporting roller 23 serves as a tension applying roller that applies tension to the intermediate transfer belt 21. The belt supporting rollers 24 and 25 serve as first and second surface-defining rollers that in combination define an image forming surface of the intermediate transfer belt 21. The belt supporting roller 23 also functions as a counter roller provided across from a cleaning plate 271 of the belt cleaning device 27.

In the monochrome image forming mode, the first surface-defining roller 24 and the color first transfer rollers 15 (Y, M, and C) for yellow (Y), magenta (M), and cyan (C) are moved to respective retracted positions where the intermediate transfer belt 21 is spaced apart from the photoconductor drums 11 (Y, M, and C), which will be described later.

Referring to FIG. 1, the second transfer device 26 rotates while being in contact with a part of the outer surface of the intermediate transfer belt 21 that is at the second transfer position where the intermediate transfer belt 21 is supported by the belt supporting roller 22 of the intermediate transfer device 20. The second transfer device 26 is a contact-type transfer device that includes a second transfer roller to which a second transfer voltage is applied. A direct-current voltage of the polarity opposite to or the same as the polarity with which the toners are charged is applied as the second transfer voltage to the second transfer roller 26 or to the belt supporting roller 22 of the intermediate transfer device 20 from a power supply device (not illustrated).

Referring to FIG. 2, the belt cleaning device 27 includes a body 270 as a casing having an opening, the cleaning plate 271 as an exemplary contact member that is pressed against the outer surface of the intermediate transfer belt 21 having undergone the second transfer with a predetermined pressure and thus removes unwanted substances such as residual toner particles from the intermediate transfer belt 21, a delivering member 272 such as a screw auger that collects the substances such as toner particles removed by the cleaning plate 271 and delivers the substances to a collecting system (not illustrated), and other associated elements. The cleaning plate 271 is a plate-like member (for example, a blade) made of rubber or the like. The cleaning plate 271 is attached to the body 270 at the proximal end thereof, with the distal end thereof oriented toward the upstream side in the direction of rotation of the intermediate transfer belt 21. Thus, the cleaning plate 271 forms a so-called doctor blade: that is, the edge at the distal end of the cleaning plate 271 rubs the intermediate transfer belt 21 from the downstream side toward the upstream side in the direction of rotation of the intermediate transfer belt 21.

The fixing device 40 includes a housing (not illustrated) having an introducing port and a discharge port into and from which the piece of recording paper 5 is introduced and discharged. The housing houses a heating rotary member 41 in the form of a roller or a belt, a pressing rotary member 42 in the form of a roller or a belt, and other associated elements. The heating rotary member 41 is rotatable as indicated by an arrow illustrated in FIG. 1 and is heated by a heating device (not illustrated) so that the surface temperature thereof is kept at a predetermined level. The pressing rotary member 42 extends substantially in the axial direction of the heating rotary member 41 and is pressed against the heating rotary member 41 with a predetermined pressure, whereby the pressing rotary member 42 is rotatable by following the heating rotary member 41. In the fixing device 40, the point of contact between the heating rotary member 41 and the pressing rotary member 42 forms a fixing part, where a predetermined fixing process (heating and pressing) is performed.

The paper feeding device 30 is provided below the image forming devices 10 (Y, M, C, and K). The paper feeding device 30 basically includes one (or more) paper container 31 that contains a stack of pieces of recording paper 5 that are of a predetermined size, kind, or the like, and a feeding device 32 that feeds the pieces of recording paper 5 one by one from the paper container 31. The paper container 31 is attached to the apparatus body 1*a* in such a manner as to be drawable toward, for example, the front side of the apparatus body 1*a* (a side facing the user operating the image forming apparatus 1).

The pieces of recording paper 5 may each be, for example, plain paper used in an electrophotographic device such as a copier or a printer, thin paper such as tracing paper, or an over-head-projector (OHP) sheet. To improve the smoothness of the image obtained after the fixing process, the surface of the piece of recording paper 5 is desired to be as smooth as possible. In such a respect, for example, coated paper obtained by coating plain paper with resin or the like, and thick paper having a relatively heavy basis weight, such as art paper for printing purposes, are also suitable as the recording paper 5.

A paper transport path 34 extends between the paper feeding device 30 and the second transfer device 26. The paper transport path 34 is provided with one or more pairs of paper transporting rollers 33 that transport the piece of recording paper 5 fed from the paper feeding device 30 to the second transfer position, and transport guides (not illustrated). One of the pairs of paper transporting rollers 33 that is provided immediately before the second transfer position in the paper transport path 34 serves as, for example, a pair of registration rollers that adjusts the timing of allowing the piece of recording paper 5 to proceed. A paper transport path 35 extends between the second transfer device 26 and the fixing device 40. The piece of recording paper 5 having undergone the second transfer and coming out of the second transfer device 26 is transported along the paper transport path 35 to the fixing device 40. A sheet discharge path 39 provided with a pair of exit rollers 36 and a pair of paper discharging rollers 38 extends near a paper discharge port provided in the apparatus body 1*a*. The piece of recording paper 5 having undergone the fixing process and coming out of the fixing device 40 is transported by the pair of exit rollers 36 and is discharged by the pair of paper discharging rollers 38 onto a paper output portion 37 at the top of the apparatus body 1*a* from the apparatus body 1*a*.

A switching gate 43 is provided between the fixing device 40 and the pair of paper discharging rollers 38. The switching gate 43 switches the paper transport path between the sheet discharge path 39 and a duplex transport path 44. The direction of rotation of the pair of paper discharging rollers 38 is switchable between the normal direction (a discharging direction) and the reverse direction. If images are to be formed on both sides of the piece of recording paper 5, after the trailing end of the piece of recording paper 5 having an image on one side thereof passes the switching gate 43, the direction of rotation of the pair of paper discharging rollers 38 is changed from the normal direction (the discharging direction) to the reverse direction while the transport path is changed from the sheet discharge path 39 to the duplex transport path 44 by the switching gate 43. Thus, the piece of recording paper 5 is transported in the reverse direction by the pair of paper discharging rollers 38 and is introduced into the duplex transport path 44 by the switching gate 43. The duplex transport path 44 extends substantially vertically along a side face of the apparatus body 1*a*. The duplex transport path 44 is provided with pairs of paper transporting rollers 45 to 47, transport guides (not illustrated), and so forth. The pairs of paper transporting rollers 45 to 47 transport the piece of recording paper 5 such that the piece of recording paper 5 is turned over while being transported to the pairs of paper transporting rollers 33.

Referring to FIG. 1, image forming apparatus 1 includes toner cartridges 145 (Y, M, C, and K) that contain the respective developers 4 each composed of at least the toner. The toner cartridges 145 are arranged side by side in a direction orthogonal to the plane of the page and supply the developers 4 to the respective developing devices 14 (Y, M, C, and K).

The image forming apparatus 1 further includes a control device 200 that generally controls the operation of the image forming apparatus 1. The control device 200 includes the following elements (not illustrated): a central processing unit (CPU), a read-only memory (ROM), a random access memory (RAM), a connecting bus that connects the CPU, the ROM, and other associated elements to one another, a communication interface, and so forth.

Operation of Image Forming Apparatus

A basic image forming operation performed by the image forming apparatus 1 will now be described.

The following description first deals with an operation in the full-color mode in which toner images in the four respective colors (Y, M, C, and K) formed by the four respective image forming devices 10 (Y, M, C, and K) are combined into one full-color image.

Full-Color Mode

When the image forming apparatus 1 receives a command requesting the performance of an image forming operation (printing) for forming a full-color image from a device such as a user interface or a printer driver (not illustrated), relevant devices such as the four image forming devices 10 (Y, M, C, and K), the intermediate transfer device 20, the second transfer device 26, and the fixing device 40 are activated.

In the image forming devices 10 (Y, M, C, and K), referring to FIGS. 1 and 2, the respective photoconductor drums 11 rotate in the direction of the arrow A, and the respective charging devices 12 charge the surfaces of the respective photoconductor drums 11 to a predetermined polarity (the negative polarity in the present exemplary embodiment) and to a predetermined potential. Subsequently, the respective exposure devices 13 apply light to the charged surfaces of the respective photoconductor drums 11 on the basis of respective image signals obtained through the conversion of the image information into signal components for the respective colors (Y, M, C, and K) that are inputted to the image forming apparatus 1. Thus, electrostatic latent images for the respective colors each defined by a predetermined potential difference are formed on the surfaces of the respective photoconductor drums 11.

Subsequently, the electrostatic latent images for the respective colors on the photoconductor drums 11 are developed by the respective developing devices 14 (Y, M, C, and K) as follows. The toners having the respective colors (Y, M, C, and K) and charged to the predetermined polarity (the negative polarity) are supplied from the respective developing rollers 141 and are made to adhere electrostatically to the respective photoconductor drums 11. Thus, the electrostatic latent images for the respective colors on the respective photoconductor drums 11 are visualized with the respective toners into toner images in the four respective colors (Y, M, C, and K).

Subsequently, the toner images in the respective colors on the photoconductor drums 11 of the image forming devices 10 (Y, M, C, and K) are transported to the respective first transfer positions. Then, the first transfer devices 15 (Y, M, C, and K) transfer, for the first transfer, the respective toner images to the intermediate transfer belt 21, which is rotating in the direction of the arrow B, of the intermediate transfer device 20 such that the toner images are superposed one on top of another.

In the image forming devices 10 (Y, M, C, and K) having undergone the first transfer, the respective drum cleaning devices 16 clean the surfaces of the respective photoconductor drums 11 by scraping unwanted substances off the photoconductor drums 11. Thus, the image forming devices 10 (Y, M, C, and K) become ready to perform another image forming operation.

Subsequently, in the intermediate transfer device 20, the intermediate transfer belt 21 rotates and thus transports the toner images having been transferred thereto in the first transfer to the second transfer position. Meanwhile, in the paper feeding device 30, a desired piece of recording paper 5 is fed into the paper transport path 34 synchronously with the image forming operation. In the paper transport path 34, the pair of paper transporting rollers 33 serving as the pair of registration rollers allows the piece of recording paper 5 to proceed to the second transfer position in accordance with the timing of the second transfer.

At the second transfer position, the second transfer is performed in which the second transfer device 26 collectively transfers the toner images on the intermediate transfer belt 21 to the piece of recording paper 5. In the intermediate transfer device 20 having undergone the second transfer, the belt cleaning device 27 cleans the surface of the intermediate transfer belt 21 having undergone the second transfer by removing unwanted substances such as residual toner particles from the intermediate transfer belt 21.

Subsequently, the piece of recording paper 5 now having the toner images transferred thereto in the second transfer is released from the intermediate transfer belt 21 and is transported along the paper transport path 35 to the fixing device 40. In the fixing device 40, the piece of recording paper 5 having undergone the second transfer is introduced into and is passed through the point of contact between the heating rotary member 41 and the pressing rotary member 42 that are under rotation, whereby a predetermined fixing process (heating and pressing) is performed. Thus, the toner images on the piece of recording paper 5 are fixed. In the case of simplex image formation in which an image is to be formed only on one side of the piece of recording paper 5, the piece of recording paper 5 having undergone the fixing process is discharged by the pair of paper discharging rollers 38 to, for example, the paper output portion 37 provided at the top of the apparatus body 1*a*.

Through the above series of operations, a piece of recording paper 5 having a full-color image composed of toner images in the four respective colors is outputted.

Monochrome Mode

Now, the monochrome mode will be described in which a black-and-white (monochrome) toner image is formed by using only the image forming device 10K for black (K).

Figure 3:
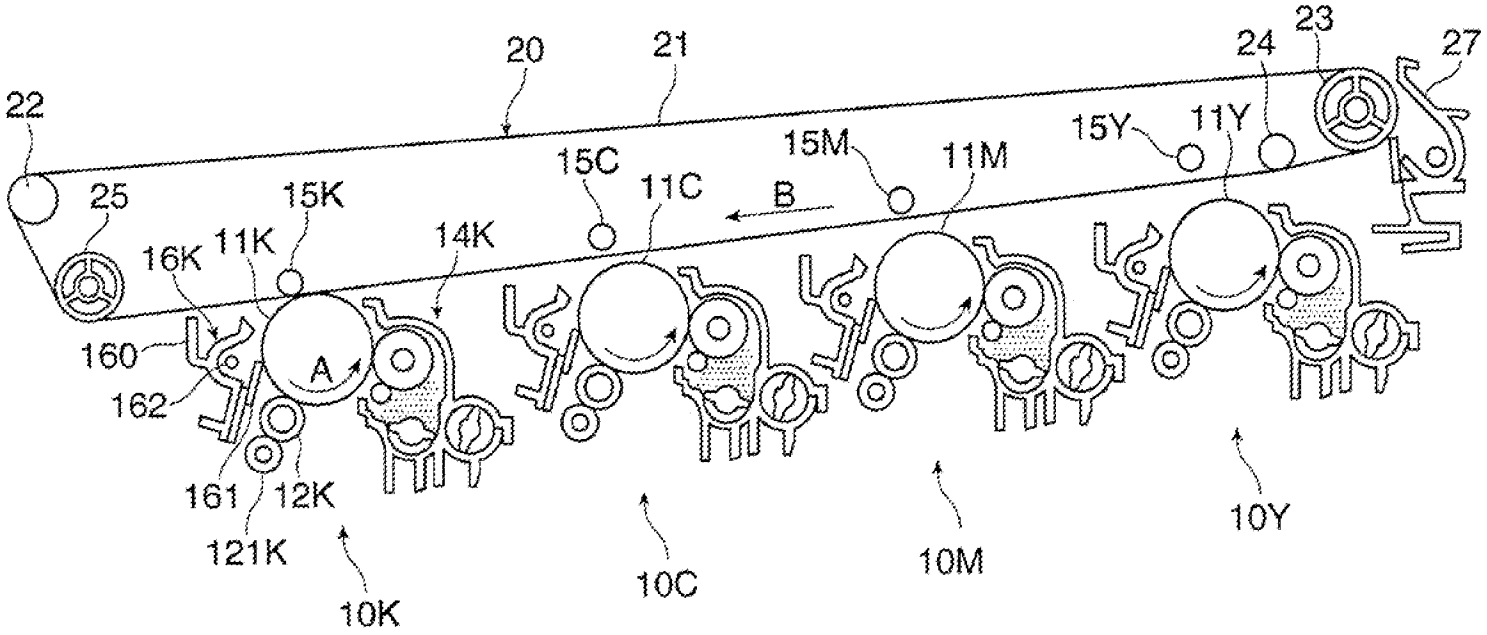
FIG. 3 illustrates the image forming section of the image forming apparatus that is in a monochrome mode.

When the image forming apparatus 1 receives a command requesting the performance of an image forming operation (printing) for forming a monochrome image from a device such as a user interface or a printer driver (not illustrated), referring now to FIG. 3, the first surface-defining roller 24 is moved upward to the retracted position by a retracting unit (not illustrated) prior to the image forming operation. Simultaneously, the color first transfer rollers 15 (Y, M, and C) of the color image forming devices 10 (Y, M, and C) are also moved to the respective retracted positions that are spaced apart from the respective color photoconductor drums 11 (Y, M, and C). Then, relevant devices such as the image forming device 10K for black (K), the intermediate transfer device 20, the second transfer device 26, and the fixing device 40 are activated. In the image forming apparatus 1 according to the present exemplary embodiment, the device such as the user interface or the printer driver (not illustrated) automatically selects the monochrome image forming operation (printing), unless the user selects the full-color image forming operation (printing) through the device such as the user interface or the printer driver.

When the color first transfer rollers 15 (Y, M, and C) are at the retracted positions, the color first transfer rollers 15 (Y, M, and C) are spaced apart from the intermediate transfer belt 21, that is, out of contact with the intermediate transfer belt 21. The monochrome mode differs from the full-color mode in that the color image forming devices 10 (Y, M, and C) and the color first transfer rollers 15 (Y, M, and C) for yellow (Y), magenta (M), and cyan (C) are not driven and are therefore not in operation.

In the image forming device 10K for black (K), the photoconductor drum 11K rotates in the direction of the arrow A, and the charging device 12K charges the surface of the photoconductor drum 11K to a predetermined polarity (the negative polarity) and to a predetermined potential. Subsequently, the exposure device 13K applies light to the charged surface of the photoconductor drum 11K on the basis of a monochrome image signal inputted to the image forming apparatus 1, whereby an electrostatic latent image defined by a predetermined potential difference is formed on the photoconductor drum 11K.

Subsequently, the electrostatic latent image for a monochrome component on the photoconductor drum 11K is developed by the developing device 14K as follows. The black (K) toner charged to the predetermined polarity (the negative polarity) is supplied from the developing roller 141 and is made to adhere electrostatically to the photoconductor drum 11K. Thus, the electrostatic latent image formed on the photoconductor drum 11K is visualized with the black toner into a toner image.

Subsequently, the toner image on the photoconductor drum 11K of the image forming device 10K is transported to the first transfer position. Then, the first transfer device 15K transfers, for the first transfer, the toner image to the intermediate transfer belt 21, which is rotating in the direction of the arrow B, of the intermediate transfer device 20.

In the image forming device 10K having undergone the first transfer, the drum cleaning device 16K cleans the surface of the photoconductor drum 11K by scraping unwanted substances off the photoconductor drum 11K. Thus, the image forming device 10K becomes ready to perform another image forming operation.

Subsequently, in the intermediate transfer device 20, the intermediate transfer belt 21 rotates and thus transports the toner image having been transferred thereto in the first transfer to the second transfer position. Meanwhile, in the paper feeding device 30, a desired piece of recording paper 5 is fed into the paper transport path 34 synchronously with the image forming operation. In the paper transport path 34, the pair of paper transporting rollers 33 serving as the pair of registration rollers allows the piece of recording paper 5 to proceed to the second transfer position in accordance with the timing of the second transfer.

At the second transfer position, the second transfer is performed in which the second transfer device 26 transfers the toner image on the intermediate transfer belt 21 to the piece of recording paper 5. In the intermediate transfer device 20 having undergone the second transfer, the belt cleaning device 27 cleans the surface of the intermediate transfer belt 21 having undergone the second transfer by removing unwanted substances such as residual toner particles from the intermediate transfer belt 21.

Subsequently, the piece of recording paper 5 now having the toner image transferred thereto in the second transfer is released from the intermediate transfer belt 21 and is transported along the paper transport path 35 to the fixing device 40. In the fixing device 40, the piece of recording paper 5 having undergone the second transfer is introduced into and is passed through the point of contact between the heating rotary member 41 and the pressing rotary member 42 that are under rotation, whereby a predetermined fixing process (heating and pressing) is performed. Thus, the toner image on the piece of recording paper 5 is fixed. In the case of simplex image formation in which an image is to be formed only on one side of the piece of recording paper 5, the piece of recording paper 5 having undergone the fixing process is discharged by the pair of paper discharging rollers 38 to, for example, the paper output portion 37 provided at the top of the apparatus body 1*a*.

Through the above series of operations, a piece of recording paper 5 having a monochrome image composed only of a toner image in black (K) is outputted.

Configuration of Featured Elements of Image Forming Apparatus

Figure 4:
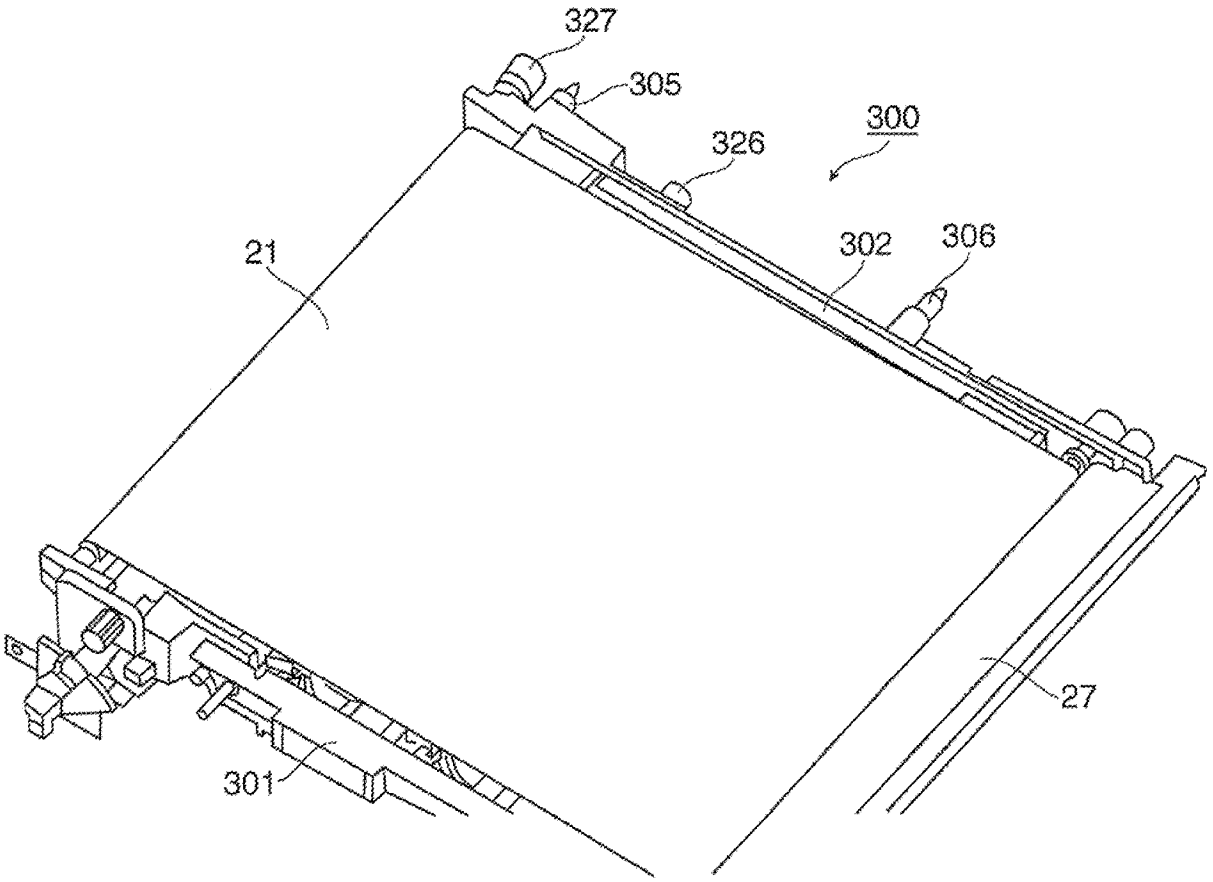
FIG. 4 is a perspective view of an intermediate transfer unit.
Figure 5:
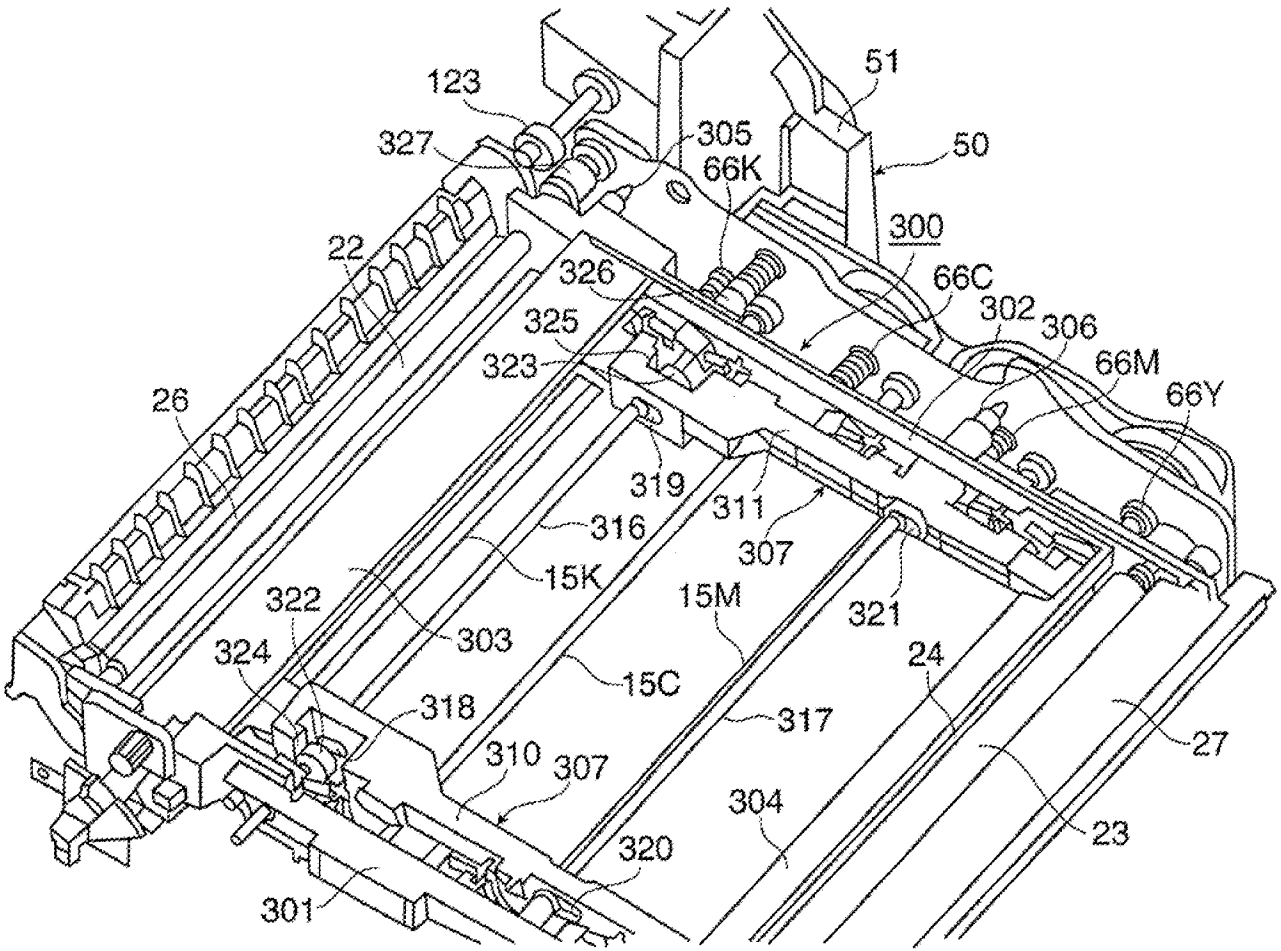
FIG. 5 is a perspective view of the intermediate transfer unit, with an intermediate transfer belt thereof removed.

Referring now to FIGS. 4 and 5, the intermediate transfer device 20 includes the intermediate transfer belt 21, the plural belt supporting rollers 22 to 25 provided on the inner side of the intermediate transfer belt 21, the first transfer rollers 15 (Y, M, C, and K) as the first transfer devices, and other associated elements, all of which are integrated into an intermediate transfer unit 300. The intermediate transfer unit 300 is an exemplary detachable structure and is detachable from the apparatus body 1*a*.

The intermediate transfer unit 300 includes a front frame 301 provided on the front side of the apparatus body 1*a* and having a long, narrow, substantially rectangular front-view shape, a rear frame 302 provided on the rear side of the apparatus body 1*a* and having a long, narrow, substantially rectangular front-view shape, and first and second connecting frames 303 and 304 that connect the front frame 301 and the rear frame 302 to each other. The plural belt supporting rollers 22 to 25, around which the intermediate transfer belt 21 is stretched, and the first transfer devices 15 (Y, M, C, and K) are rotatably supported by the front frame 301 and the rear frame 302. The rear frame 302 is provided with guide pins 305 and 306 projecting toward the rear side. The guide pins 305 and 306 are intended for the positioning of the intermediate transfer unit 300 when the intermediate transfer unit 300 is attached to the apparatus body 1*a*.

Figure 6:
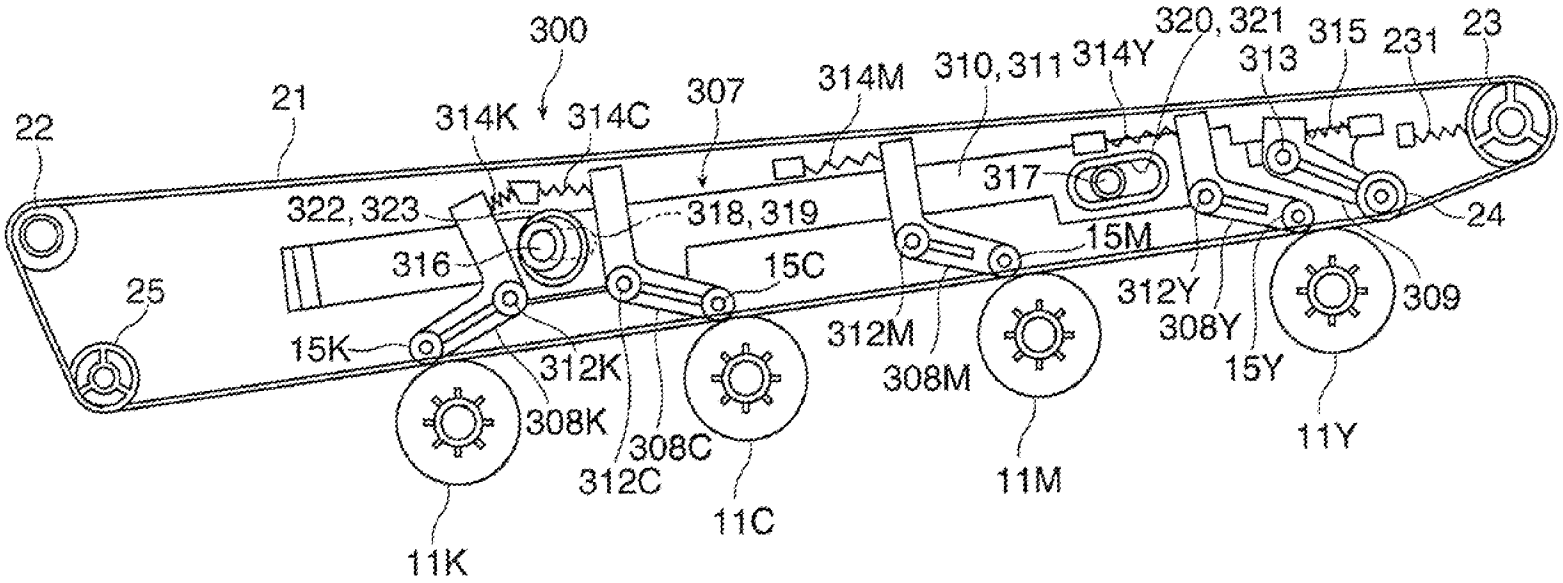
FIG. 6 illustrates the intermediate transfer unit that is in a full-color mode.

Referring to FIGS. 5 and 6, the intermediate transfer unit 300 further includes thereinside a retracting unit 307 that moves the color first transfer rollers 15 (Y, M, and C) and the first surface-defining roller 24 to the respective retracted positions. The retracting unit 307 includes first arm members 308 (Y, M, C, and K), a second arm member 309, and a pair of slide members 310 and 311. The first arm members 308 each have a substantially L front-view shape and support the respective first transfer rollers 15 (Y, M, C, and K) while allowing the rotation of the first transfer rollers 15. The second arm member 309 has a substantially L front-view shape and supports the first surface-defining roller 24 while allowing the rotation of the first surface-defining roller 24. The pair of slide members 310 and 311 rotate the first arm members 308 (Y, M, and C), excluding the one for black (K), and the second arm member 309. The first arm members 308 (Y, M, C, and K) and the second arm member 309 are each attached to the inner side faces of the front frame 301 and the rear frame 302 in such a manner as to be rotatable about points of rotation 312 (Y, M, C, and K) and a point of rotation 313, respectively. The first arm members 308 (Y, M, C, and K) are provided at the proximal ends thereof with first coil springs 314 (Y, M, C, and K), respectively, as urging members that urge the first arm members 308 (Y, M, C, and K) such that the first transfer rollers 15 (Y, M, C, and K) are pressed against the respective photoconductor drums 11. The second arm member 309 is provided at the proximal end thereof with a second coil spring 315 as an urging member that urges the second arm member 309 such that the first surface-defining roller 24 is positioned at an operating position. The first and second coil springs 314 (Y, M, C, and K) and 315 are each a compression spring. Referring to FIG. 6, a third coil spring 231 as an urging member urges the tension applying roller 23 toward the outer side in the longitudinal direction of the intermediate transfer unit 300.

Referring to FIGS. 5 and 6, the pair of slide members 310 and 311 are supported by a driving shaft 316 and a fixed shaft 317 that each bridge the front frame 301 and the rear frame 302. The driving shaft 316 is rotatable. The fixed shaft 317 is fixed. The driving shaft 316 and the fixed shaft 317 extend through oblong holes 318 and 319 and oblong holes 320 and 321, respectively. Thus, the slide members 310 and 311 are slidable in the longitudinal direction of the intermediate transfer unit 300.

The driving shaft 316 is provided with eccentric cams 322 and 323 that move the slide members 310 and 311 back and forth in the longitudinal direction of the intermediate transfer unit 300. The slide members 310 and 311 include cam followers 324 and 325 (see FIG. 5) with which the eccentric cams 322 and 323 are in contact, respectively. The slide members 310 and 311 are urged by coil springs or the like (not illustrated) such that the cam followers 324 and 325 are pressed against the eccentric cams 322 and 323, respectively. The driving shaft 316 is driven by a driving device 50 with the aid of a coupling member 326 interposed therebetween and thus rotates clockwise or counterclockwise at a predetermined timing. The driving device 50 is provided to the apparatus body 1*a*.

Figure 7:
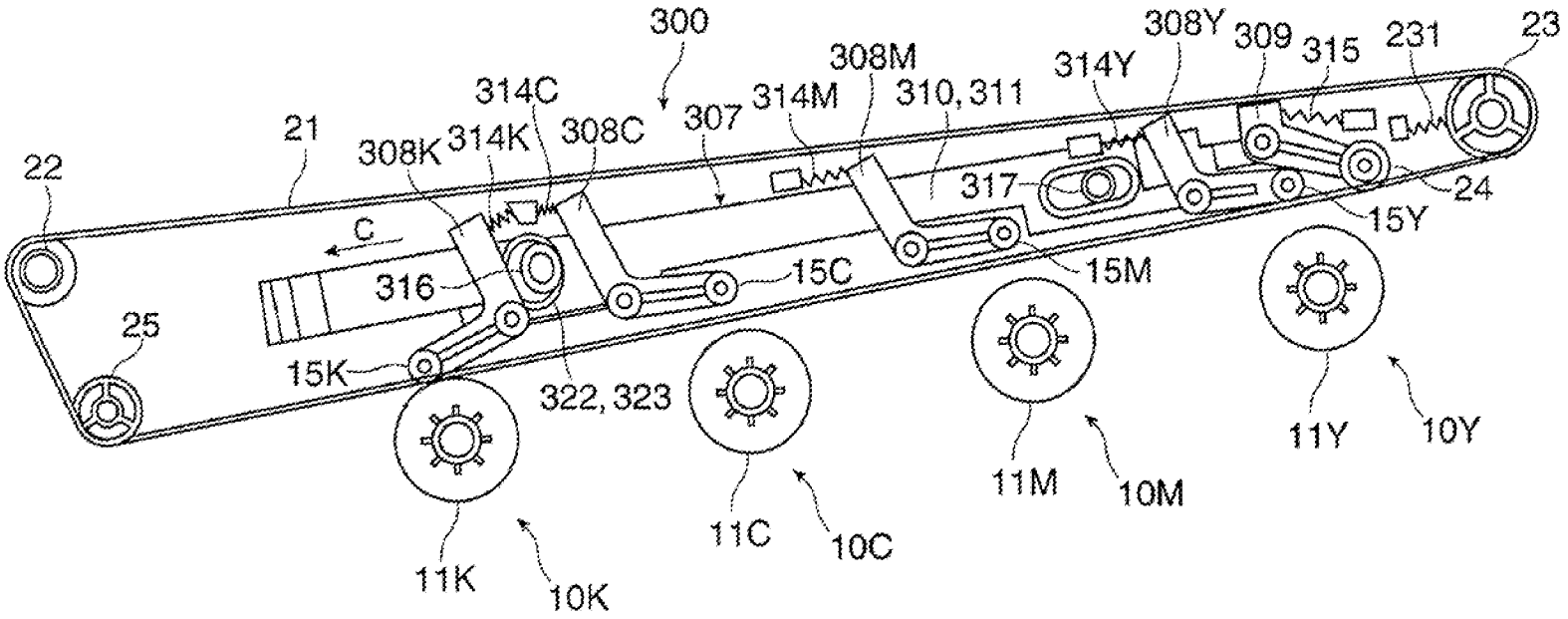
FIG. 7 illustrates the intermediate transfer unit that is in the monochrome mode.

When the mode is changed from the full-color mode to the monochrome mode, referring now to FIG. 7, the eccentric cams 322 and 323 are driven to rotate by the driving device 50, whereby the slide members 310 and 311 slide in a direction of an arrow C with the aid of the cam followers 324 and 325. The first arm members 308 (Y, M, and C) and the second arm member 309 are connected to the slide members 310 and 311 and therefore rotate counterclockwise in FIG. 7 with the sliding of the slide members 310 and 311 in the direction of the arrow C. Accordingly, the color first transfer rollers 15 (Y, M, and C) rotatably provided to the respective first arm members 308 (Y, M, and C) are moved to the respective retracted positions that are spaced apart from the respective photoconductor drums 11 (Y, M, and C) and from the intermediate transfer belt 21, and the first surface-defining roller 24 rotatably provided to the second arm member 309 is also moved to the retracted position.

Configuration of Driving Device

Referring to FIG. 5, the driving device 50 that drives relevant devices such as the four image forming devices 10 (Y, M, C, and K), the intermediate transfer device 20, the second transfer device 26, the paper feeding device 30, and the fixing device 40 is provided on the rear side of the image forming apparatus 1.

Figure 8:
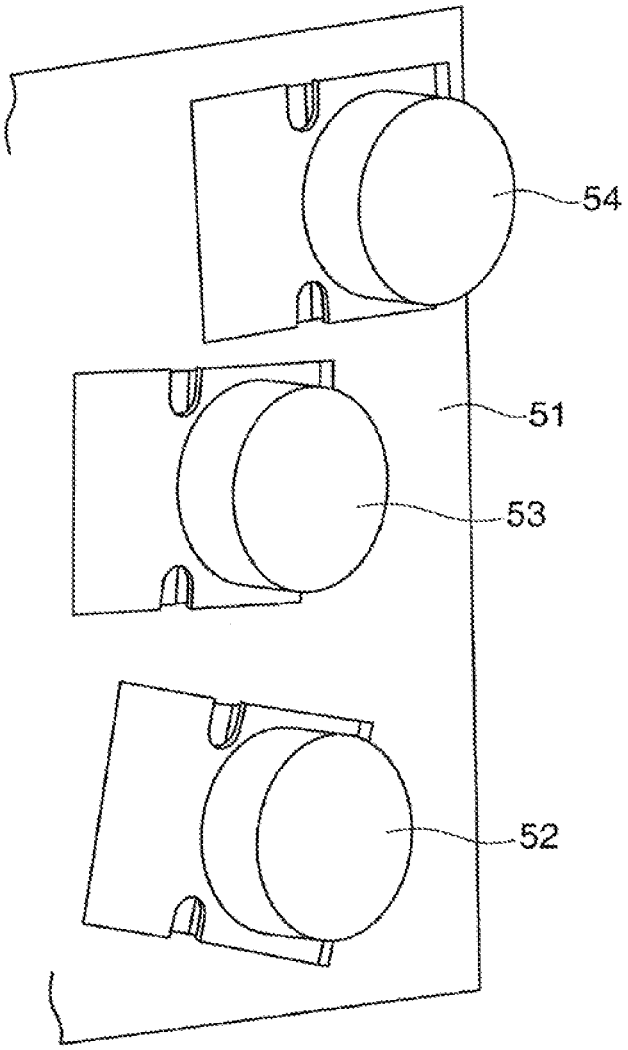
FIG. 8 is a perspective view of driving motors included in a driving device.

Referring to FIG. 8, the driving device 50 includes first to third driving motors 52 to 54 as drive sources attached to the rear face of a housing 51 of the driving device 50. The first to third driving motors 52 to 54 are each a direct-current (DC) motor or the like. The first driving motor 52 as a first motor basically drives the four developing devices 14 (Y, M, C, and K) for yellow, magenta, cyan, and black and the paper feeding device 30. The second driving motor 53 as a drum motor basically drives the four photoconductor drums 11 (Y, M, C, and K) for yellow, magenta, cyan, and black and the intermediate transfer belt 21. The third driving motor 54 as a fuser motor basically drives the fixing device 40 and the paper discharging system.

Figure 9:
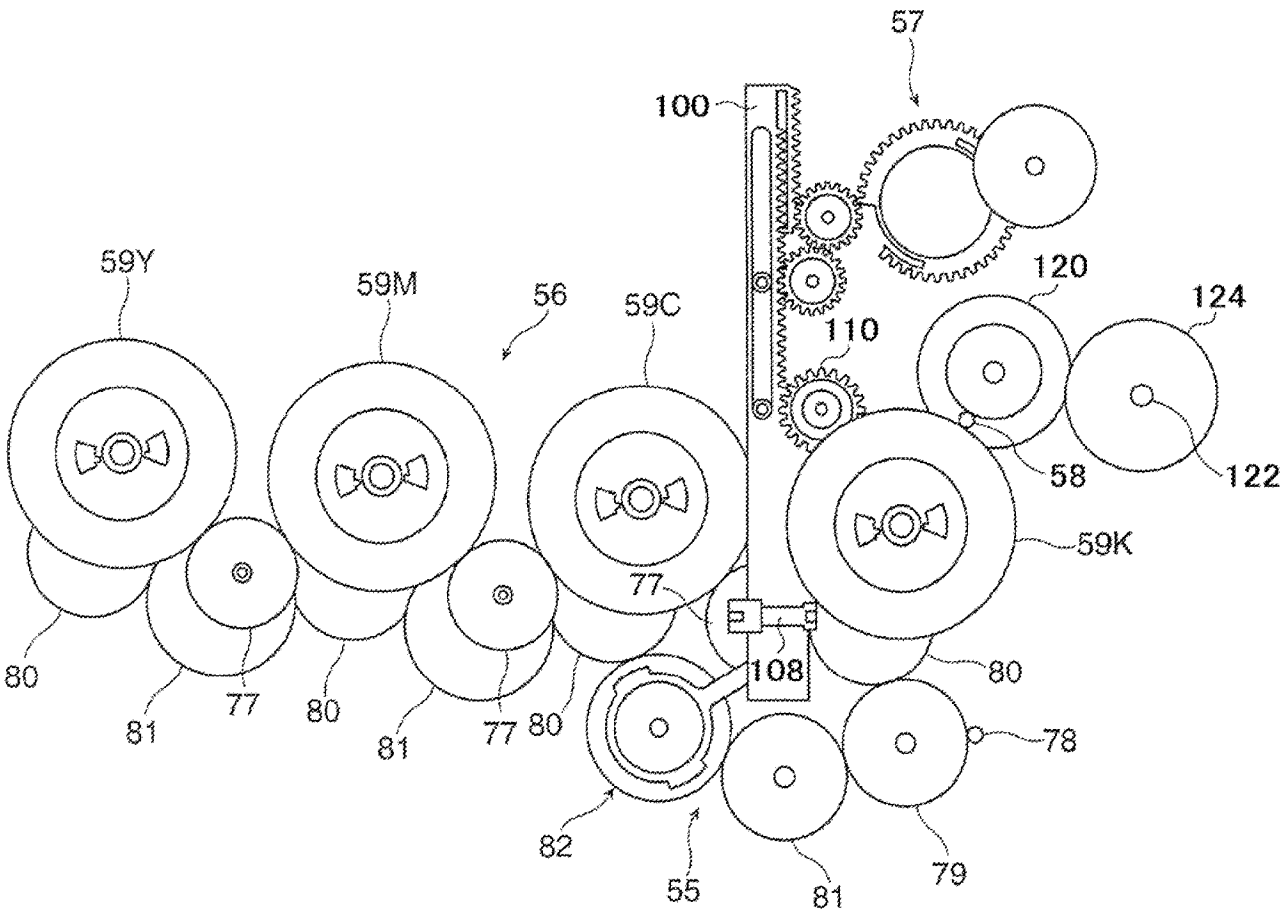
FIG. 9 illustrates the driving device.

Referring to FIG. 9, elements included in the driving device 50 are roughly grouped into a first driving device 55 driven by the first driving motor 52, a second driving device 56 driven by the second driving motor 53, and a third driving device 57 driven by the third driving motor 54.

The second driving device 56 includes a driving gear 59 (59K) that is in mesh with an output gear 58. The output gear 58 is provided on an output shaft of the second driving motor 53. The driving gear 59K drives the photoconductor drum 11K for black (K) to rotate. The output gear 58 included in the second driving motor 53 is in mesh with a transmission gear 120 that is in mesh with a driving gear 124 that drives the driving roller 22 of the intermediate transfer unit 300 to rotate. Referring to FIG. 5, a rotating shaft 122 of the driving gear 124 is connected to the driving roller 22 with a coupling member 327 interposed therebetween. In FIG. 5, a driving gear 123 helps the third driving motor 54 drive the fixing device 40.

Figure 10A:
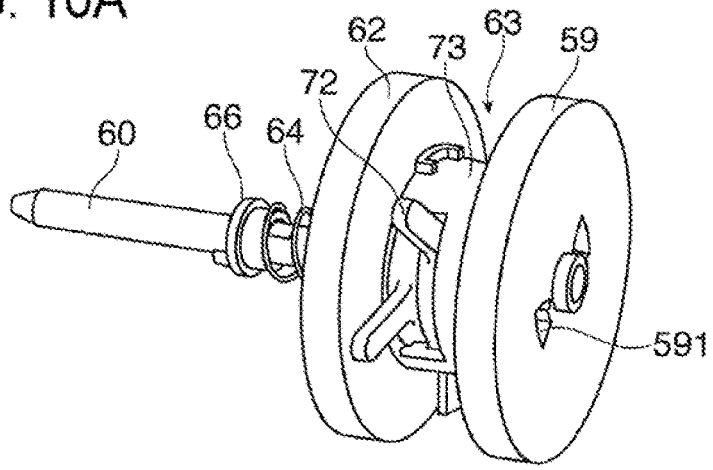
FIGS. 10A to 10C are perspective views of a driving-force-transmitting mechanism provided for a photoconductor drum.
Figure 10B:
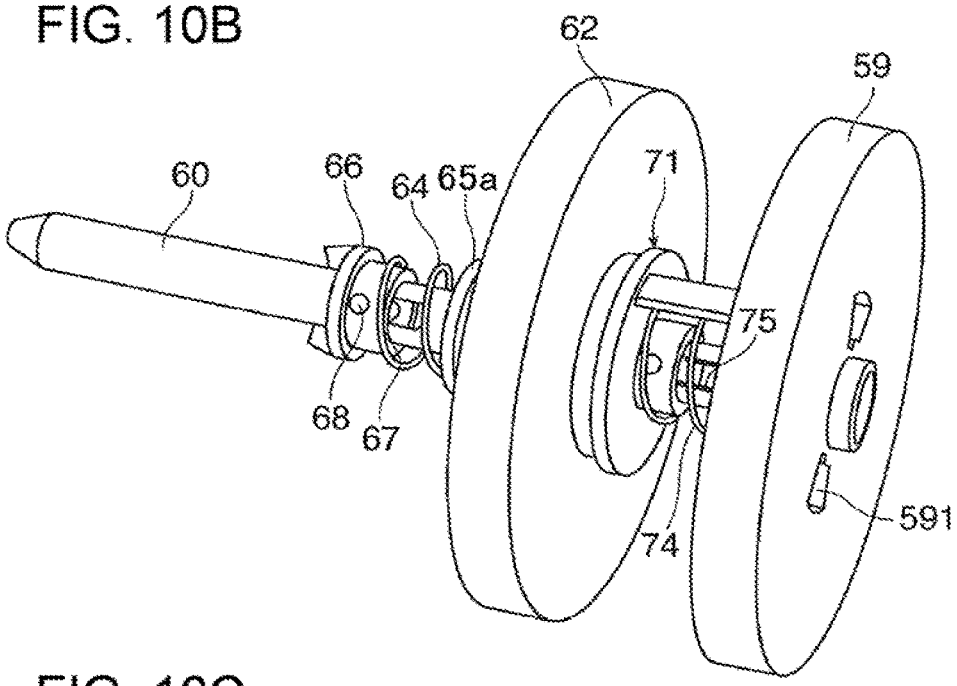
Figure 10C:
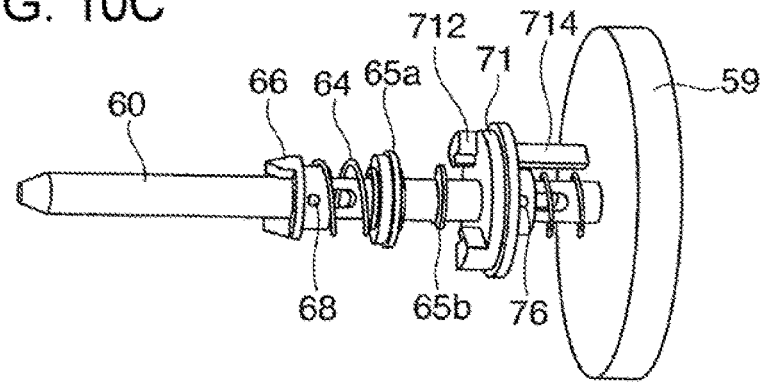
Figure 12:
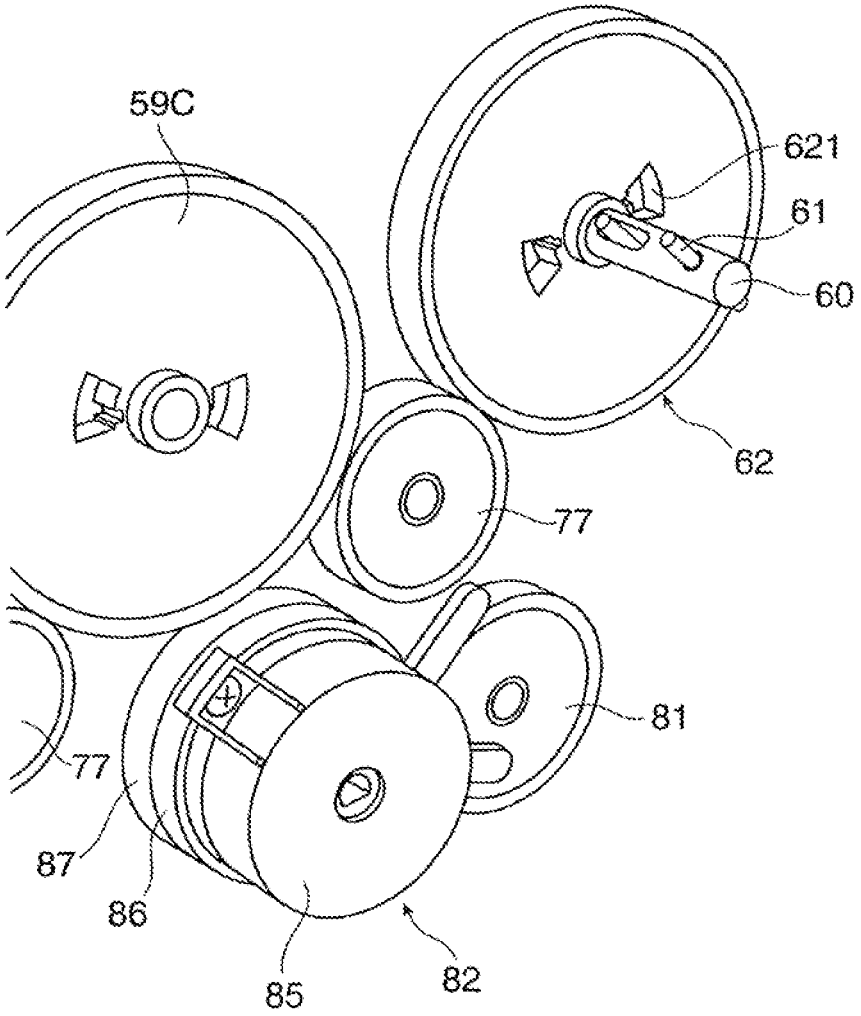
FIG. 12 is another perspective view of the driving-force-transmitting mechanism provided for the photoconductor drum.

Referring to FIGS. 10A to 10C, the driving gear 59 (59K) is fixed to a driving shaft 60 with a pin 61 (see FIG. 12). The driving gear 59 drives the photoconductor drum 11K for black (K) to rotate. The driving shaft 60 is provided with a transmission gear 62 that is rotatable thereon. The transmission gear 62 transmits a rotational driving force to the color photoconductor drums 11 (Y, M, and C). A photoconductor coupling mechanism 63 as a driving-force-transmitting mechanism is provided between the driving gear 59 and the transmission gear 62. The photoconductor coupling mechanism 63 changes the state of transmission of the rotational driving force from the driving gear 59 to the transmission gear 62 between an enabled state and a disabled state.

The transmission gear 62 is held between a first annular member 65*a* and a second annular member 65*b*, thereby being restricted from moving in the axial direction of the driving shaft 60. A coupling member 66 is attached to a side of the first annular member 65*a* that is nearer to the tip of the driving shaft 60. The coupling member 66 is connected to the photoconductor drum 11K and transmits the rotational driving force to the photoconductor drum 11K. The coupling member 66 is pressed toward the photoconductor drum 11K by a coil spring 64. The movable range of the coupling member 66 is restricted by a pin 68. The pin 68 extends through a first long hole 67 provided in the driving shaft 60 and extending in the axial direction of the driving shaft 60.

Referring to FIGS. 10A to 10C, the photoconductor coupling mechanism 63 basically includes a coupling member 71, a link member 72, and a covering member 73.

Figure 11A:
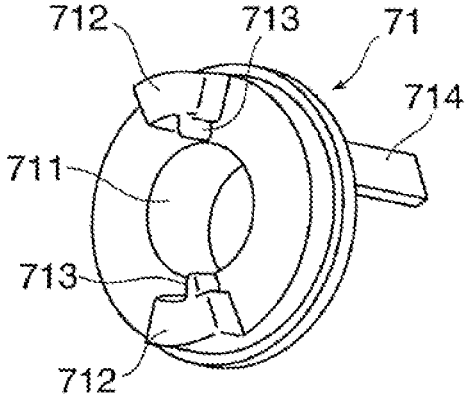
FIGS. 11A to 11C are perspective views of members included in the driving-force-transmitting mechanism.
Figure 11B:
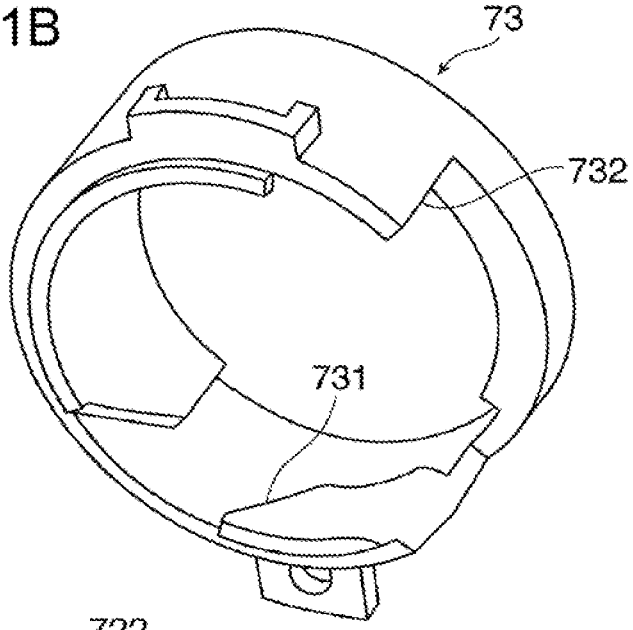
Figure 11C:
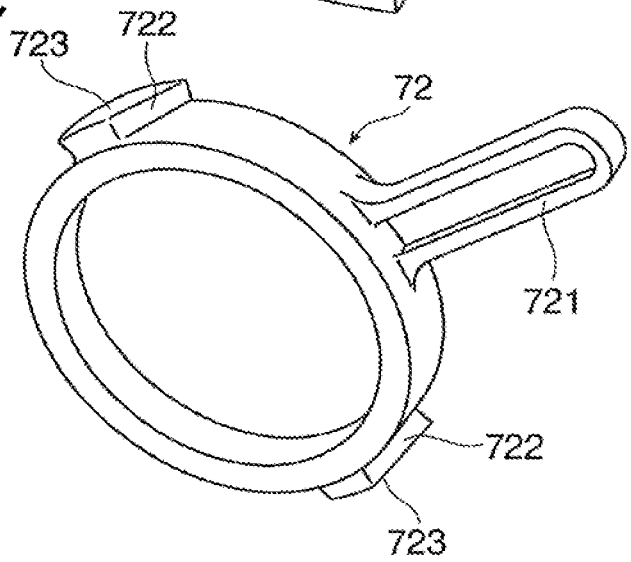

Referring to FIGS. 11A to 11C, the coupling member 71 has a substantially disc-like shape with a fitting hole 711 that allows the coupling member 71 fitted on the driving shaft 60 to move in the axial direction of the driving shaft 60. The coupling member 71 further has, on an end face thereof facing the transmission gear 62, first projections 712 projecting in the axial direction of the driving shaft 60 from the outer periphery of the coupling member 71. The first projections 712 are provided at respective positions that are at 180 degrees with respect to each other. When seen in the axial direction, the first projections 712 each have a substantially trapezoidal shape defined by arc-shaped outer and inner surfaces extending in the peripheral direction and two end surfaces extending in the radial direction. The first projections 712 each have a protrusion 713 protruding inward in the radial direction from the inner peripheral surface thereof. The protrusion 713 is provided at a position shifted toward one side (the right side in FIG. 11A) from the center of the inner peripheral surface of a corresponding one of the first projections 712. Therefore, the two first projections 712 each have an asymmetrical shape with respect to the center line of the driving shaft 60. The driving gear 59 and the transmission gear 62 come to be in phase with each other with the aid of the protrusions 713. Furthermore, the coupling member 71 has, on an end face thereof facing the driving gear 59, a second projection 714 that is longer than each of the first projections 712. The second projection 714 is provided on the outer periphery of the coupling member 71 and projects therefrom in the axial direction. The position of the second projection 714 in the peripheral direction of the coupling member 71 is staggered with respect to the positions of the first projections 712. The second projection 714 has, for example, the same shape as the first projections 712 when seen in the axial direction and has a protrusion 713.

Referring now to FIG. 12, the transmission gear 62 has first recesses 621 provided at 180 degrees with respect to each other. The first recesses 621 each have a shape similar to that of each first projection 712 of the coupling member 71. The first projections 712 are to be fitted into the respective first recesses 621. Referring to FIGS. 10A to 10C, the driving gear 59 has at least one second recess 591. The second recess 591 has a shape similar to that of the second projection 714 of the coupling member 71 and receives the second projection 714. In the present exemplary embodiment, the driving gear 59 and the transmission gear 62 are of the same kind with two second recesses 591 provided in the driving gear 59 so that the number of components is reduced by standardization of components.

The first projections 712 have the respective protrusions 713 provided at positions that are shifted from the center line of the driving shaft 60. Therefore, the coupling member 71 and the transmission gear 62 are only allowed to be coupled with each other at one angle in the peripheral direction where the coupling member 71 and the transmission gear 62 are in phase with each other (the coupling member 71 and the transmission gear 62 are oriented at the same angle in the peripheral direction). Furthermore, the second projection 714 has the protrusion 713, as with the first projections 712. Therefore, the coupling member 71 and the driving gear 59 are only allowed to be coupled with each other at one angle in the peripheral direction where the coupling member 71 and the driving gear 59 are in phase with each other (the coupling member 71 and the driving gear 59 are oriented at the same angle in the peripheral direction). Consequently, in a state where the driving gear 59 is connected to the transmission gear 62 with the aid of the coupling member 71, the driving gear 59 and the transmission gear 62 are always in phase with each other.

Referring to FIG. 10B, a coil spring 74 is provided between the driving gear 59 and the coupling member 71. The coil spring 74 presses the coupling member 71 in a direction away from the driving gear 59. The movable range of the coupling member 71 is restricted by a pin 76. The pin 76 extends through a second long hole 75 provided in the driving shaft 60 and extending in the axial direction of the driving shaft 60.

Referring to FIG. 11C, the link member 72 has an annular shape and includes a lever 721 projecting radially outward from the outer peripheral surface of the annular part thereof. The link member 72 further includes protrusions 723 provided on the outer peripheral surface thereof and at 180 degrees with respect to each other. The protrusions 723 each have a sloping surface 722.

Referring to FIG. 11B, the covering member 73 has a cylindrical shape that covers the outer periphery of the link member 72. The covering member 73 has sloping surfaces 731 on the inner peripheral side thereof. The sloping surfaces 731 are in contact with the respective protrusions 723 of the link member 72. The covering member 73 also has an open part 732 that allows the lever 721 of the link member 72 to project outward therefrom. The open part 732 is open by a predetermined angle. The covering member 73 is fixed to the housing 51 of the driving device 50 (see FIG. 5).

Therefore, when the link member 72 is rotated by using the lever 721, the sloping surfaces 722 of the protrusions 723 are pressed against the respective sloping surfaces 731 of the covering member 73 that is fixedly provided, whereby the link member 72 is moved in the axial direction. Such a movement of the link member 72 pushes the coupling member 71 in the axial direction toward the transmission gear 62. Then, as illustrated in FIG. 10C, the second projection 714 of the coupling member 71 goes out of the second recess 591 of the driving gear 59. Hence, the transmission of the rotational driving force from the driving gear 59 to the transmission gear 62 is disabled. In contrast, when the link member 72 is rotated in the reverse direction by using the lever 721, the coupling member 71 is pushed by the link member 72 in the axial direction toward the driving gear 59. Then, the second projection 714 of the coupling member 71 is fitted into the second recess 591 of the driving gear 59. Hence, the transmission of the rotational driving force from the driving gear 59 to the transmission gear 62 is enabled.

Referring to FIG. 12, the transmission gear 62 provided on the driving shaft 60 of the photoconductor drum 11K for black and driving gears 59 (59C, 59M, and 59Y) of the photoconductor drums 11 (11C, 11M, and 11Y) for cyan, magenta, and yellow are in mesh with one another in that order with intermediate gears 77 interposed between adjacent ones thereof. The driving gears 59 (59K, 59C, 59M, and 59Y), the transmission gear 62, and the intermediate gears 77 in combination form a driving-force-transmitting unit of the second driving device 56.

Referring now to FIG. 9, the first driving device 55 includes a transmission gear 79 and a driving gear 80. The transmission gear 79 and the driving gear 80 receive a rotational driving force from an output gear 78 provided on the driving shaft of the first driving motor 52, and the driving force is transmitted to the developing device 14K for black (K). Thus, the developing device 14K for black (K) is driven to rotate by the driving gear 80.

The transmission gear 79 is connected to a developing-device coupling mechanism 82 with the aid of a follower gear 81. The developing-device coupling mechanism 82 is a driving-force-transmitting mechanism that transmits a rotational driving force to the color developing devices 14 (Y, M, and C). The developing-device coupling mechanism 82 basically has the same configuration as the photoconductor coupling mechanism 63.

Figure 13:
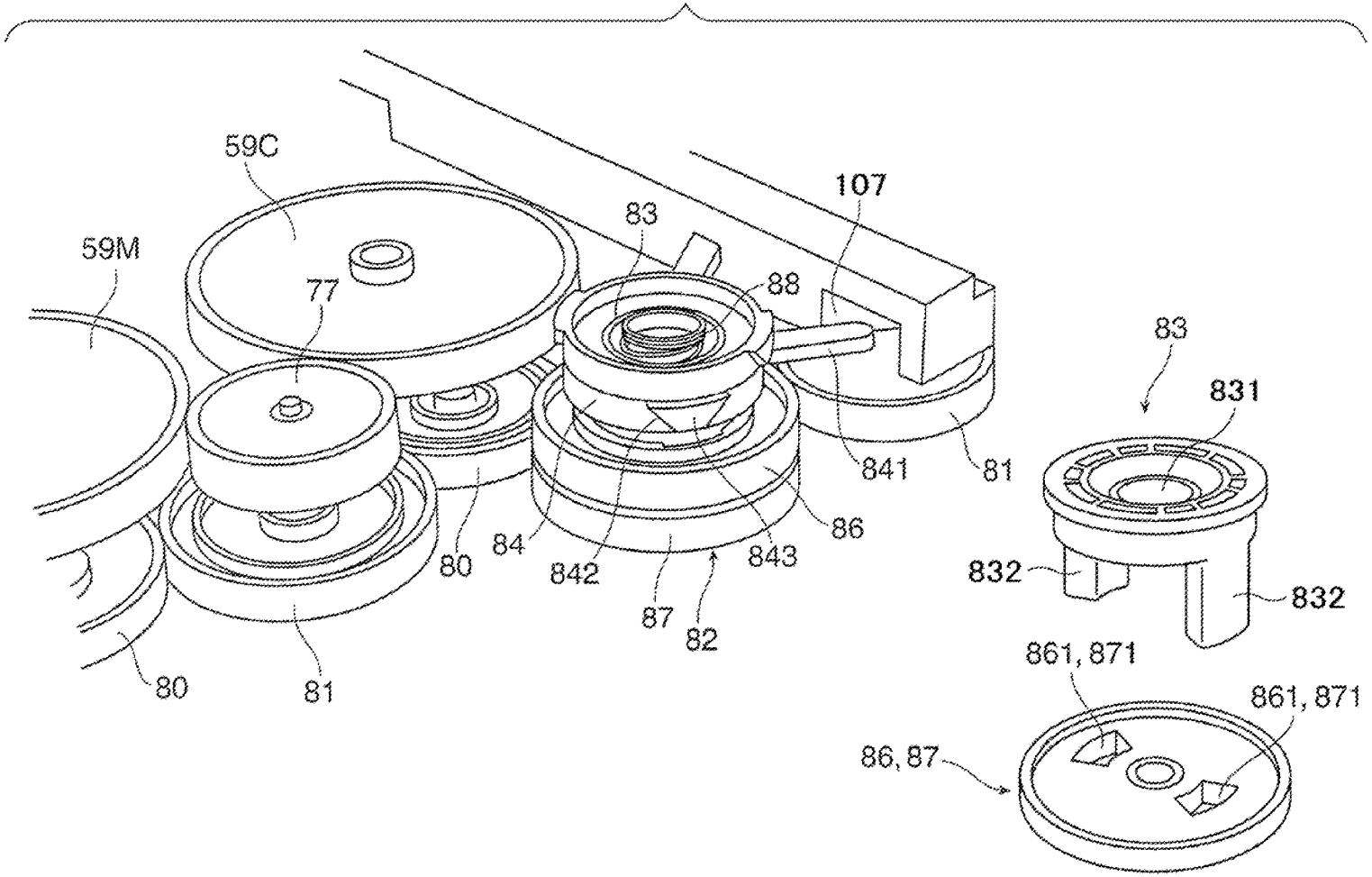
FIG. 13 is a perspective view of a driving-force-transmitting mechanism provided for a developing device.

Referring to FIG. 13, the developing-device coupling mechanism 82 basically includes a coupling member 83, a link member 84, and a covering member 85 (see FIG. 12). The coupling member 83 has a substantially disc-like shape with a fitting hole 831 that allows the coupling member 83 to be fitted on a rotating shaft (not illustrated). The developing-device coupling mechanism 82 differs from the photoconductor coupling mechanism 63 in that a driving gear 86 and a transmission gear 87 are provided on the same side with respect to the coupling member 83 in the axial direction. The driving gear 86 is in mesh with the follower gear 81.

The coupling member 83 has two projections 832 on the outer periphery of an end face thereof facing the driving gear 86 and the transmission gear 87. The projections 832 project in the axial direction from respective positions that are at 180 degrees with respect to each other. When seen in the axial direction, the projections 832 each have a substantially trapezoidal shape defined by arc-shaped outer and inner surfaces extending in the peripheral direction and two end surfaces extending in the radial direction. Note that, unlike the case of the photoconductor coupling mechanism 63, the projections 832 each have no protrusions that correspond to the protrusions 713.

The driving gear 86 and the transmission gear 87 each have two recesses 861 or 871 having a shape similar to that of the projections 832 of the coupling member 83 and provided at 180 degrees with respect to each other. The recesses 861 or 871 receive the respective projections 832. In the present exemplary embodiment, the driving gear 86 and the transmission gear 87 are of the same kind so that the number of components is reduced by standardization of components.

A coil spring 88 is provided between the inner surface of the covering member 85 and the coupling member 83. The coil spring 88 presses the coupling member 83 in such a direction (downward in FIG. 13) that the driving gear 86 and the transmission gear 87 are coupled to each other.

The link member 84 has an annular shape, as with the link member 72 illustrated in FIG. 11C, and includes a lever 841 projecting radially outward from the outer peripheral surface of the annular part thereof. The link member 84 further includes protrusions 843 provided on the outer peripheral surface thereof and at 180 degrees with respect to each other. The protrusions 843 each have a sloping surface 842.

Referring to FIG. 12, the covering member 85 has a lidded cylindrical shape that covers the outer periphery of the link member 84. The covering member 85 has sloping surfaces (not illustrated) on the inner peripheral side thereof, as with the covering member 73 illustrated in FIG. 11B. The sloping surfaces are in contact with the respective protrusions 843 of the link member 84. The covering member 85 also has an open part (not illustrated) that allows the lever 841 of the link member 84 to project outward therefrom. The open part is open by a predetermined angle. The covering member 85 is fixed to the housing 51 of the driving device 50 (see FIG. 5).

Therefore, when the link member 84 is rotated by using the lever 841, the sloping surfaces 842 of the protrusions 843 are pressed against the respective sloping surfaces (not illustrated) of the covering member 85, whereby the link member 84 is moved in the axial direction. Such a movement of the link member 84 pushes the coupling member 83 in the axial direction toward the driving gear 86 and the transmission gear 87. Then, the projections 832 of the coupling member 83 are fitted into the recesses 861 and 871 of the driving gear 86 and the transmission gear 87. Hence, the transmission of the rotational driving force from the driving gear 86 to the transmission gear 87 is enabled.

In contrast, when the link member 84 is rotated in the reverse direction by using the lever 841, the sloping surfaces 842 of the protrusions 843 are pressed against the sloping surfaces (not illustrated) of the covering member 85, whereby the link member 84 is moved in the axial direction. Such a movement of the link member 84 pushes the coupling member 83 in the axial direction and moves away from the driving gear 86 and the transmission gear 87. Then, the projections 832 of the coupling member 83 go out of the respective recesses 871 of the transmission gear 87. Hence, the transmission of the rotational driving force from the driving gear 86 to the transmission gear 87 is disabled.

Referring to FIG. 13, driving gears 80 are each in mesh with an input gear (not illustrated) of a corresponding one of the color developing devices 14. Furthermore, follower gears 81 are each interposed between adjacent ones of the driving gears 80 of the color developing devices 14. Thus, the driving force is transmitted to the color developing devices 14 sequentially. The driving gears 80, the driving gear 86, the transmission gear 87, the input gears, and the follower gears 81 in combination form a driving-force-transmitting unit of the second driving device 56.

Figure 14:
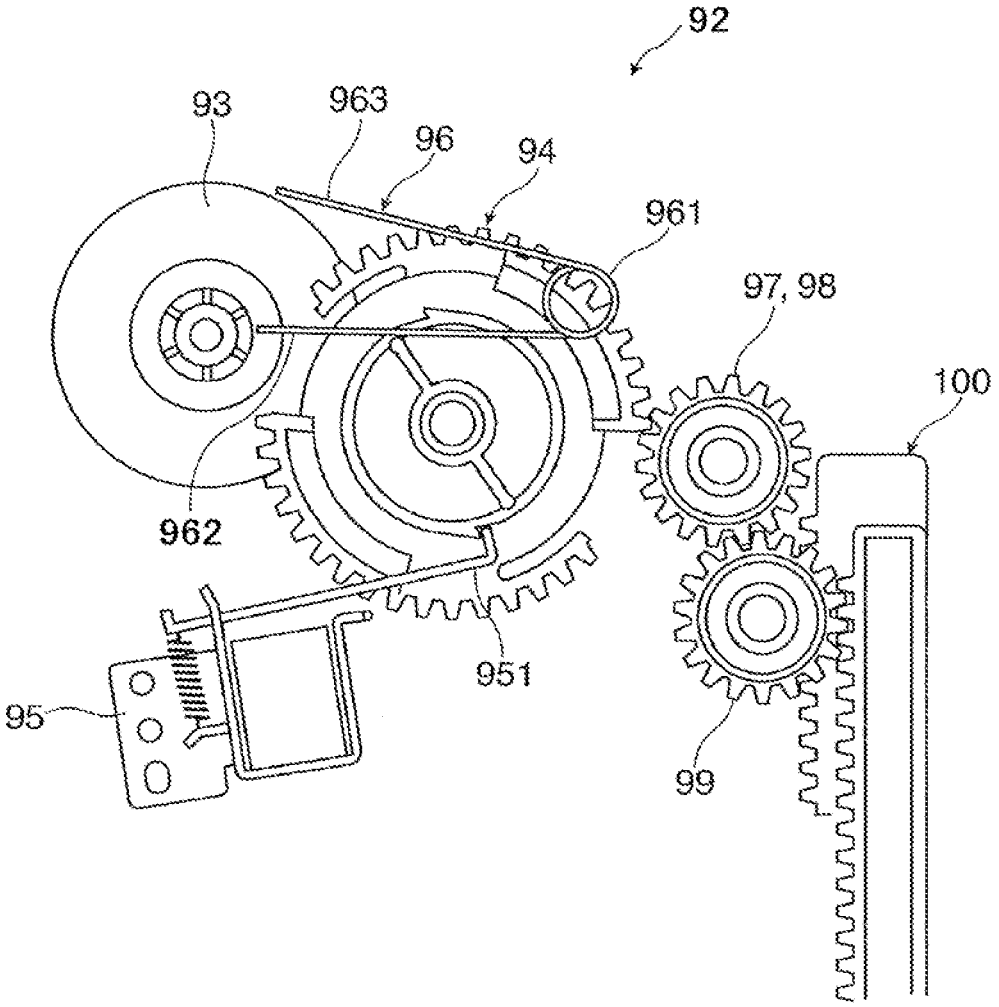
FIG. 14 illustrates a drive switching device.

FIG. 14 illustrates a drive switching device 92 according to the present exemplary embodiment.

The drive switching device 92 is driven by the third driving motor 54 of the third driving device 57. The third driving motor 54 is driven to rotate only in one direction. The drive switching device 92 basically includes a driving gear 93 that receives a rotational driving force from the third driving motor 54, a two-tiered partially toothless gear 94 that intermittently comes into mesh with a small-diameter portion of the driving gear 93 and thus receives the driving force, a solenoid 95 and a torsion spring 96 that intermittently drive the partially toothless gear 94, a first switching gear 97 that selectively comes into mesh with the partially toothless gear 94 and thus changes the direction of transmission of the driving force to a first direction, and second switching gears 98 and 99 that selectively come into mesh with the partially toothless gear 94 and thus change the direction of transmission of the driving force to a second direction.

Referring to FIGS. 15A to 15D, the partially toothless gear 94 includes a large-diameter portion 941 having a hollow cylindrical shape with a relatively large diameter, a small-diameter portion 942 provided integrally with the large-diameter portion 941 at one axial end of the large-diameter portion 941 and having a hollow cylindrical shape with a smaller diameter than the large-diameter portion 941, and a bearing portion 943 having a long, narrow cylindrical shape extending in the axial direction through the centers of the large-diameter portion 941 and the small-diameter portion 942 and rotatably supported by a rotating shaft of a housing (not illustrated).

The partially toothless gear 94 includes a first toothed part 944 and a second toothed part 945 each extending along the outer periphery of the large-diameter portion 941 thereof. The first toothed part 944 and the second toothed part 945 are staggered with respect to each other in the axial direction and in the radial direction. The first toothed part 944 and the second toothed part 945 have respective arc shapes that are symmetrical with respect to the axis of rotation of the partially toothless gear 94 and are each defined by a central angle smaller than 180 degrees. The partially toothless gear 94 further includes, between the first toothed part 944 and the second toothed part 945, gap parts 946 and 947 where no teeth are provided on the outer periphery of the large-diameter portion 941. The gap parts 946 and 947 are at 180 degrees with respect to each other.

The first and second toothed parts 944 and 945 each form a two-tiered gear including two tiers provided on the upstream side and the downstream side, respectively, in the peripheral direction. The two tiers are staggered with respect to each other in the axial direction but are integrated with each other at the center of the toothed part 944 or 945. More specifically, the first and second toothed parts 944 and 945 each include an upstream tier 944*a* or 945*a* extending in the peripheral direction and provided on one side in the axial direction, and a downstream tier 944*b* or 945*b* extending in the peripheral direction and provided on the other side in the axial direction. The upstream tier 944*a* or 945*a* and the downstream tier 944*b* or 945*b* overlap each other in a middle part 944*c* or 945*c*.

The first and second toothed parts 944 and 945 each have a notch 948 extending along the inner peripheral side of an upstream end 944*a*' or 945*a*' over a predetermined length. Hence, the upstream ends 944*a*' and 945*a*' are each elastically deformable toward the inner peripheral side. The upstream ends 944*a*' and 945*a*' each have, for example, about three to five teeth.

Referring to FIGS. 14 and 15A to 15D, the small-diameter portion 942 of the partially toothless gear 94 includes locking parts 949 provided on the outer peripheral surface thereof at 180 degrees with respect to each other. When a hook 951 of the solenoid 95 is caught by one of the locking parts 949, the rotation of the partially toothless gear 94 is stopped. The small-diameter portion 942 of the partially toothless gear 94 further includes an actuating part 940 projecting from an axial end thereof and having a flat plate-like shape extending in the diametrical direction thereof. A first linear part 962 of the torsion spring 96 is pressed against the actuating part 940 and applies an elastic force acting counterclockwise in FIG. 14 to the partially toothless gear 94. The torsion spring 96 is made of an elastic wire rod and includes a coiled part 961 that is coiled circularly, and the first linear part 962 and a second linear part 963 each being tangent to the coiled part 961 and extending linearly. The coiled part 961 of the torsion spring 96 is positioned with respect to the housing (not illustrated). The position of the second linear part 963 is restricted by the housing (not illustrated). Thus, a downward pressing force acts on the first linear part 962.

The first and second switching gears 97, 98, and 99 are provided across the partially toothless gear 94 from the driving gear 93. The partially toothless gear 94 intermittently comes into mesh with the first switching gear 97 or the second switching gear 98, whereby the first switching gear 97 or the second switching gear 98 are rotated by a predetermined angle. The first and second switching gears 97, 98, and 99 are, for example, of the same kind. The second switching gear 98 is in mesh with the second switching gear (reversal gear) 99 that reverses the direction of the rotational driving force.

Figure 16:
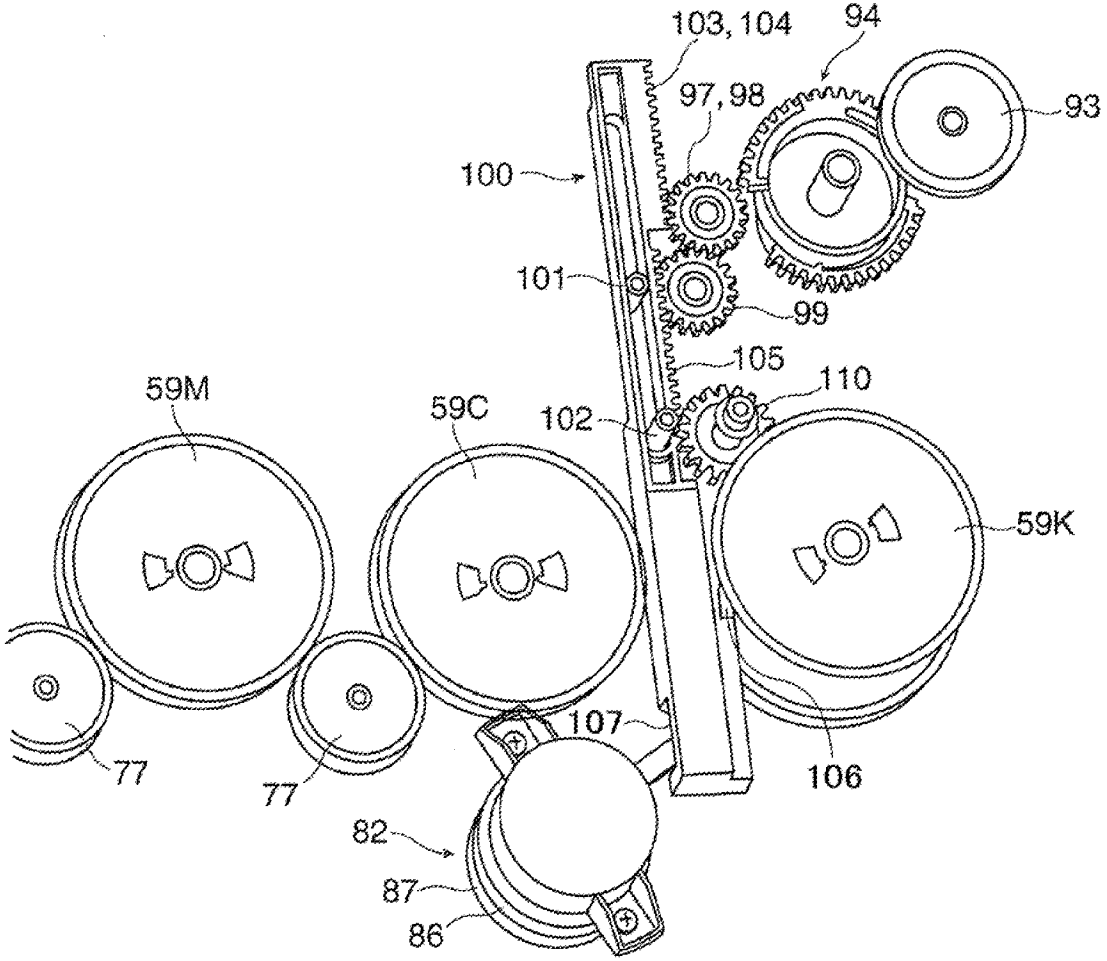
FIG. 16 is a perspective view of the driving device.

An actuating plate 100 that changes the state of connection in the photoconductor coupling mechanism 63 and in the developing-device coupling mechanism 82 is provided on one side of the first and second switching gears 97 and 98. Referring to FIG. 16, the actuating plate 100 has a long, narrow, quadrangular prism shape and is attached to the housing 51 of the driving device 50 in such a manner as to be movable vertically with the aid of two rotating rollers 101 and 102. The actuating plate 100 has first and second racks 103 and 104 provided at the upper end on one side thereof. The first switching gear 97 and the reversal gear 99 are in mesh with the first and second racks 103 and 104, respectively. Furthermore, the actuating plate 100 has a third rack 105 in a middle part on the one side thereof. The third rack 105 is in mesh with a driving gear 110 that drives the eccentric cams 322 and 323 (see FIG. 6) to rotate.

The first and second racks 103 and 104 of the actuating plate 100 are provided at respective predetermined positions and each have a predetermined number of teeth. Likewise, the third rack 105 is provided at a predetermined position and has a predetermined number of teeth.

Furthermore, the actuating plate 100 has a first recess 106 in a middle part on the one side thereof. The first recess 106 receives the link member 72 of the photoconductor coupling mechanism 63. Furthermore, the actuating plate 100 has a second recess 107 at the lower end on the other side thereof. The second recess 107 receives the link member 84 of the developing-device coupling mechanism 82.

Referring to FIG. 9, the actuating plate 100 has, at a lower end on the front face thereof, a protrusion (not illustrated) that is to be detected by a home position sensor 108 provided on the housing 51. The home position sensor 108 detects whether or not the actuating plate 100 is at the home position.

Figure 23:
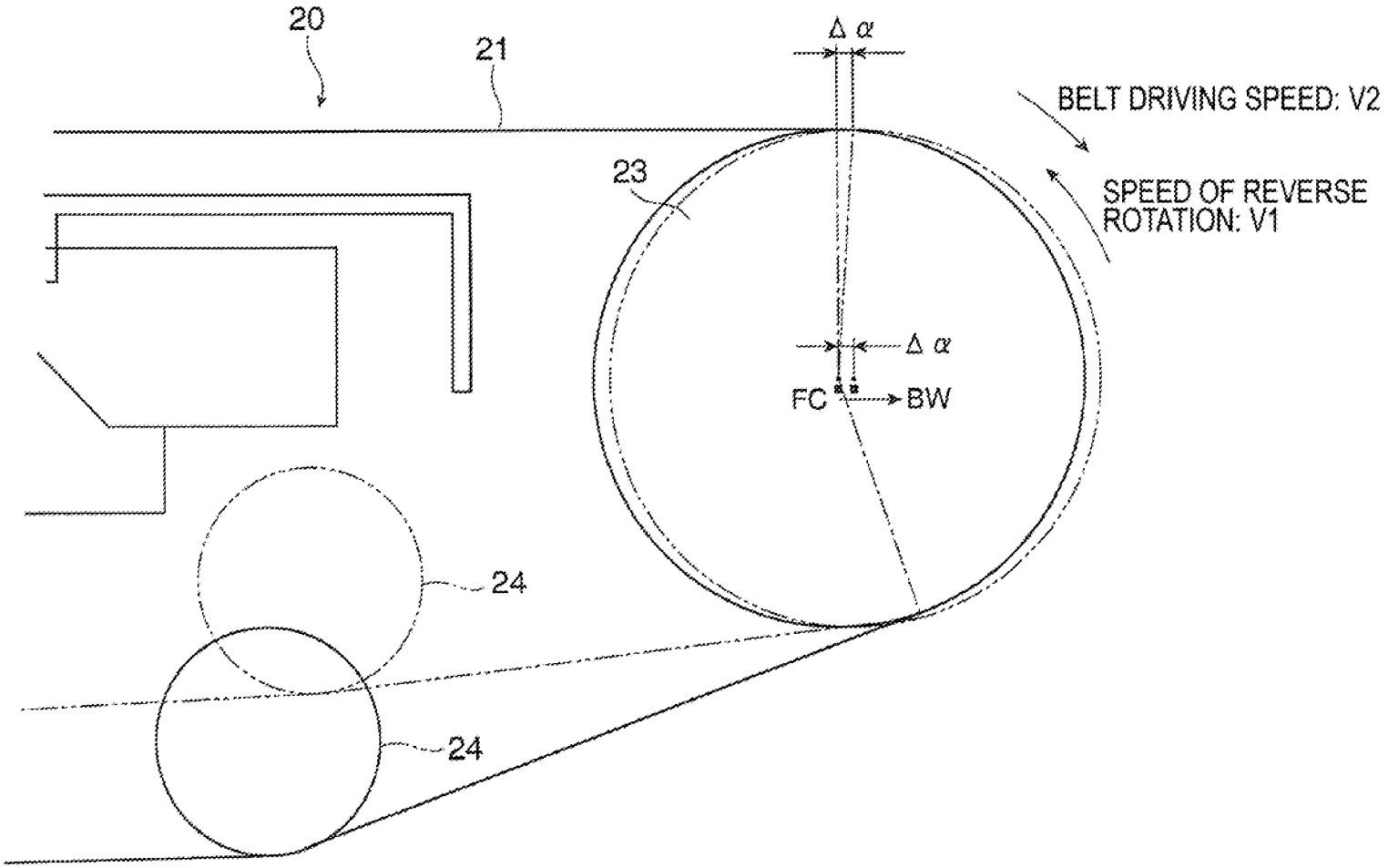
FIG. 23 illustrates a movement of a tension applying roller.

The image forming apparatus 1 according to the present exemplary embodiment is basically used in the monochrome mode. Considering such a fact, the image forming apparatus 1 is configured such that, when an image forming operation in the full-color mode ends, the mode is automatically changed to the monochrome mode and the operation of the image forming apparatus 1 is stopped. Referring to FIG. 7, when the mode of the image forming apparatus 1 is changed from the full-color mode to the monochrome mode, the first surface-defining roller 24 is moved to the retracted position and the color first transfer rollers 15 (Y, M, and C) are moved away from the respective photoconductor drums 11 and the intermediate transfer belt 21. Consequently, a stretched length L of the intermediate transfer belt 21 between the first transfer roller 15K for black (K) and the tension applying roller 23 in the peripheral direction becomes shorter than that observed in the full-color mode by a length corresponding to the movement of the first surface-defining roller 24 to the retracted position. Therefore, to maintain the tension applied to the intermediate transfer belt 21 to a constant level, the tension applying roller 23 is moved outward, as illustrated in FIG. 23, in the longitudinal direction of the intermediate transfer unit 300 by a length $\Delta\alpha$. When the tension applying roller 23 is moved outward in the longitudinal direction of the intermediate transfer unit 300, the tension applying roller 23 slightly rotates counterclockwise in FIG. 23. With the rotation of the tension applying roller 23, the intermediate transfer belt 21 provided round the tension applying roller 23 rotates in the reverse direction.

Figure 24A:
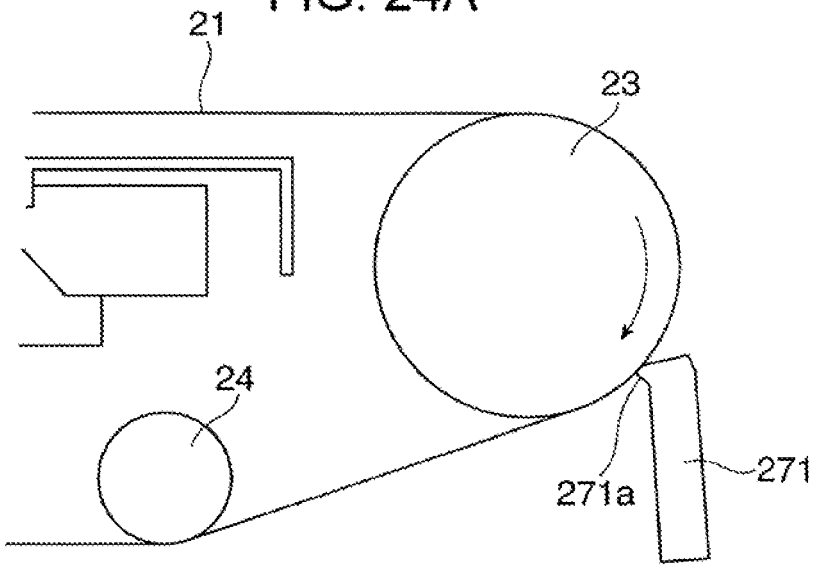
FIGS. 24A and 24B illustrate a cleaning plate that is in contact with the tension applying roller.
Figure 24B:
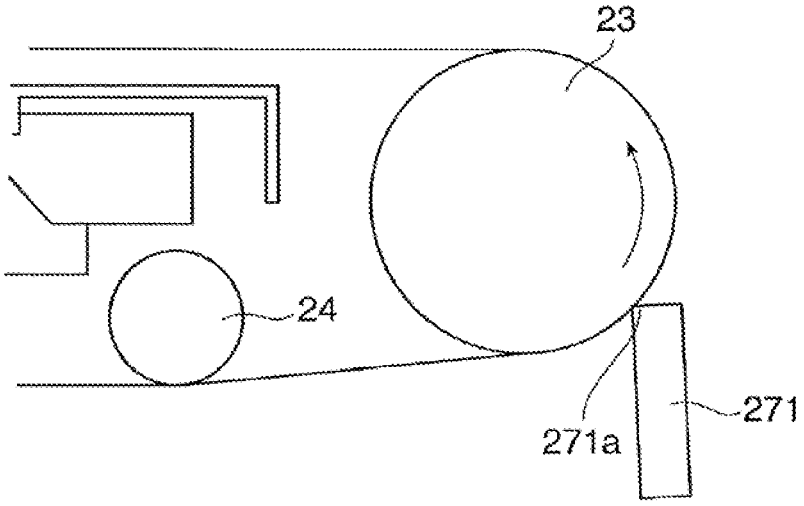

Referring to FIG. 24A, the cleaning plate 271 of the belt cleaning device 27 is pressed against the tension applying roller 23 with the intermediate transfer belt 21 interposed therebetween, and the cleaning plate 271 is oriented against the direction of rotation of the intermediate transfer belt 21. Therefore, referring to FIG. 24B, when the intermediate transfer belt 21 rotates in the reverse direction, an edge 271*a* of the cleaning plate 271 of the belt cleaning device 27 that has been dragged by the surface of the intermediate transfer belt 21 is released and is deformed.

When an image forming operation in the full-color mode ends, the image forming apparatus 1 falls into the monochrome mode. Therefore, when another image forming operation is started, the tension applying roller 23 rotates in the normal direction, i.e., clockwise, and the intermediate transfer belt 21 also rotates in the normal direction. Then, as illustrated in FIG. 24A, the edge 271*a* of the cleaning plate 271 of the belt cleaning device 27 is bent toward the leading side in the direction of rotation of the intermediate transfer belt 21.

Hence, in the image forming apparatus 1, every time an image forming operation is performed in the full-color mode, the state of contact between the cleaning plate 271 of the belt cleaning device 27 and the surface of the intermediate transfer belt 21 changes between that in which the cleaning plate 271 is dragged by the surface of the intermediate transfer belt 21 and that in which the cleaning plate 271 has been released from the drag applied by the surface of the intermediate transfer belt 21. That is, the edge 271*a* of the cleaning plate 271 of the belt cleaning device 27 that is in contact with the intermediate transfer belt 21 may suffer from fatigue with the repeated damage and may cause a defect in the cleaning process.

Accordingly, in the present exemplary embodiment, the driving device 50 is controlled by the control device 200 such that, when the mode is changed from the full-color mode to the monochrome mode, the intermediate transfer belt 21 is rotated in the normal direction at a speed higher than or equal to the speed of reverse rotation of the intermediate transfer belt 21 that occurs with the movement of the tension applying roller 23.

Operation of Featured Elements of Image Forming Apparatus

In the image forming apparatus 1 according to the present exemplary embodiment, before an image forming operation is started, the control device 200 checks which of the full-color mode and the monochrome mode the user has selected through a device such as a user interface or a printer driver (not illustrated).

Figure 17:
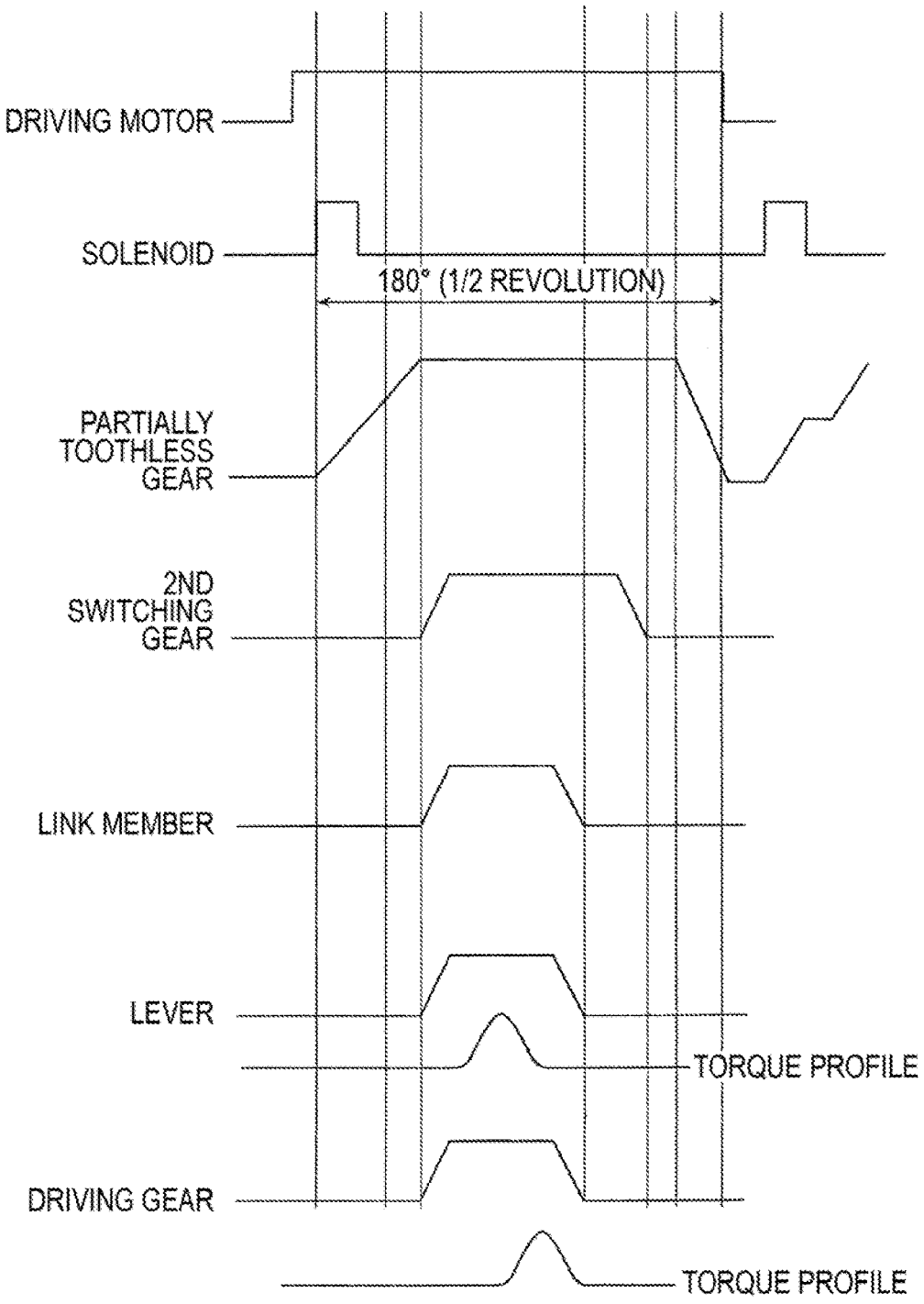
FIG. 17 is a timing chart representing an operation of the drive switching device.

If the control device 200 has recognized that the user has selected the full-color mode, referring now to FIG. 17, the third driving motor 54 is activated for a predetermined period of time and the solenoid 95 is turned on. Then, referring now to FIG. 18, the hook 951 of the solenoid 95 is disengaged from one of the locking parts 949 of the partially toothless gear 94, the actuating part 940 of the partially toothless gear 94 is pushed by the elastic force exerted by the first linear part 962 of the torsion spring 96, and the partially toothless gear 94 rotates counterclockwise in FIG. 18. When the hook 951 is disengaged from the locking part 949, the solenoid 95 is turned off before the partially toothless gear 94 rotates by 180 degrees.

Figure 18:
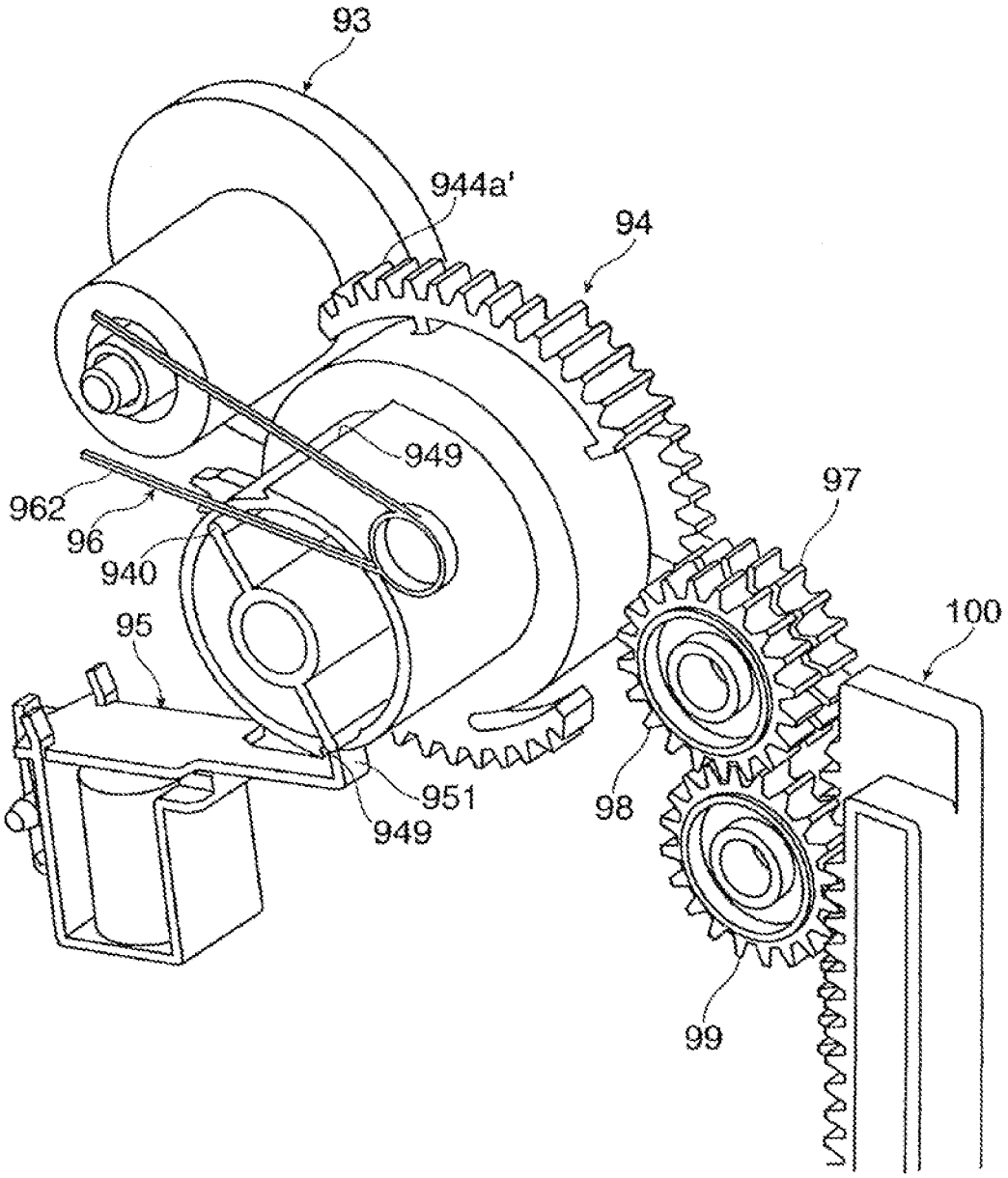
FIG. 18 is a perspective view of the drive switching device and illustrates the operation thereof.

When the partially toothless gear 94 is rotated counterclockwise in FIG. 18, the upstream end 944*a*' of the first toothed part 944 comes into mesh with the small-diameter portion of the driving gear 93 that is driven to rotate by the third driving motor 54. Therefore, the partially toothless gear 94 is rotated counterclockwise in FIG. 18 by the driving gear 93. In this step, since the first toothed part 944 of the partially toothless gear 94 is stably in mesh with the driving gear 93, the partially toothless gear 94 rotates counterclockwise in FIG. 18 at a constant speed with the rotational driving force transmitted thereto from the driving gear 93.

Figure 19:
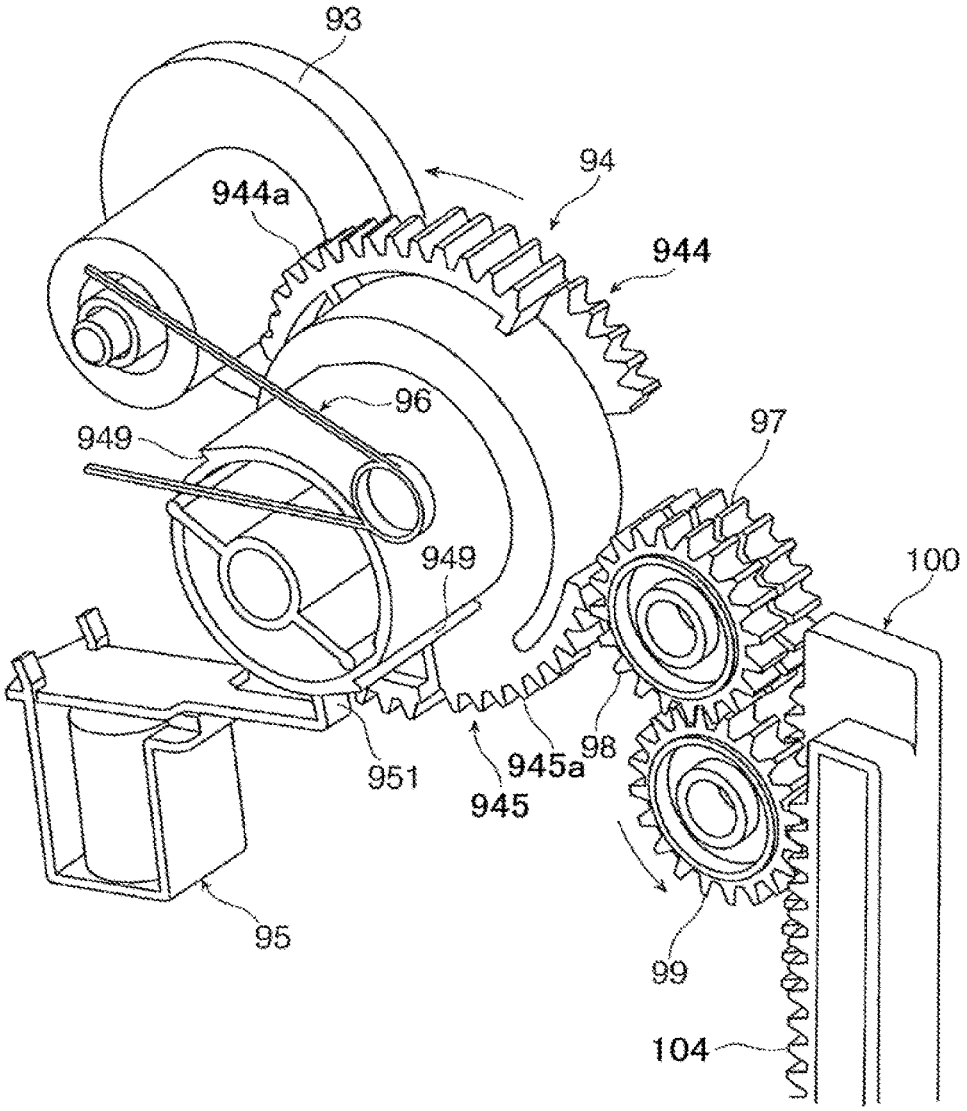
FIG. 19 is another perspective view of the drive switching device and illustrates the operation thereof.

After the first toothed part 944 of the partially toothless gear 94 has stably come into mesh with the driving gear 93 (by about three teeth), referring now to FIG. 19, the second toothed part 945 comes into mesh with the second switching gear 98 and causes the second switching gear 98 to rotate clockwise in FIG. 19. Furthermore, the direction of the rotational driving force exerted by the second switching gear 98 is reversed by the reversal gear 99. Then, the actuating plate 100 is moved upward with the rotation of the reversal gear 99 that is in mesh with the second rack 104.

With the upward movement of the actuating plate 100, the link member 72 of the photoconductor coupling mechanism 63 and the link member 84 of the developing-device coupling mechanism 82 that are received in the first recess 106 and the second recess 107, respectively, of the actuating plate 100 are rotated. In the photoconductor coupling mechanism 63, the lever 721 of the link member 72 is rotated upward. Accordingly, referring to FIGS. 10A to 10C, the coupling member 71 is pushed toward the driving gear 59, and the second projection 714 of the coupling member 71 is inserted into one of the second recesses 591 of the driving gear 59. Consequently, when the driving gear 59 is driven, the rotational driving force exerted by the driving gear 59 is transmitted to the transmission gear 62. In the image forming operation, since the transmission gear 62 is driven to rotate, the other driving gears 59 provided on the driving shafts of the respective color photoconductor drums 11 (Y, M, and C) are driven to rotate with the aid of the intermediate gear 77 that is in mesh with the transmission gear 62, and the color photoconductor drums 11 (Y, M, and C) are driven to rotate.

Meanwhile, in the developing-device coupling mechanism 82, the lever 841 of the link member 84 is rotated upward. Accordingly, referring to FIG. 13, the coupling member 83 is pushed toward the driving gear 86 and the transmission gear 87, and the projections 832 of the coupling member 83 are inserted into the recesses 861 and 871 of the driving gear 86 and the transmission gear 87. Consequently, the rotational driving force exerted by the driving gear 86 is transmitted to the transmission gear 87, and the transmission gear 87 is rotated. Thus, referring to FIG. 13, the color developing devices 14 (Y, M, and C) are rotated with the aid of the driving gear 80 that is in mesh with the transmission gear 87.

Furthermore, with the upward movement of the actuating plate 100, the driving gear 110 that is in mesh with the third rack 105 of the actuating plate 100 is rotated and causes the eccentric cams 322 and 323 to rotate clockwise in FIG. 6. Accordingly, the color first transfer rollers 15 (Y, M, and C) of the color image forming devices 10 (Y, M, and C) are moved downward, and the first surface-defining roller 24 is moved to the operating position, whereby the color first transfer rollers 15 (Y, M, and C) and the intermediate transfer belt 21 are brought into contact with the photoconductor drums 11 (Y, M, and C).

As graphed in FIG. 17, the timing of the actuating plate 100 driving the levers of the link members and the timing of the third rack 105 of the actuating plate 100 driving the eccentric cams 322 and 323 are staggered with respect to each other, so that the load applied to the third driving motor 54 is reduced.

Figure 20:
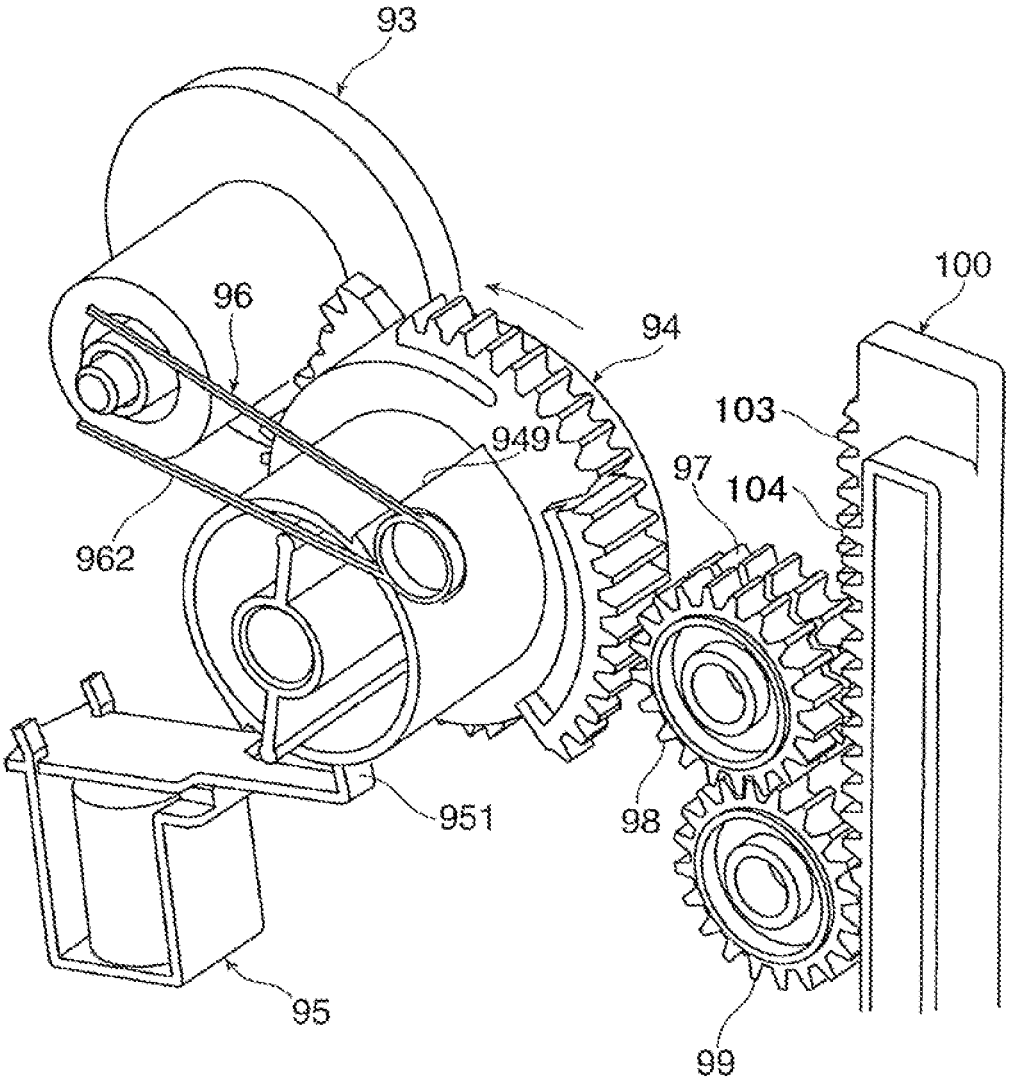
FIG. 20 is yet another perspective view of the drive switching device and illustrates the operation thereof.
Figure 21:
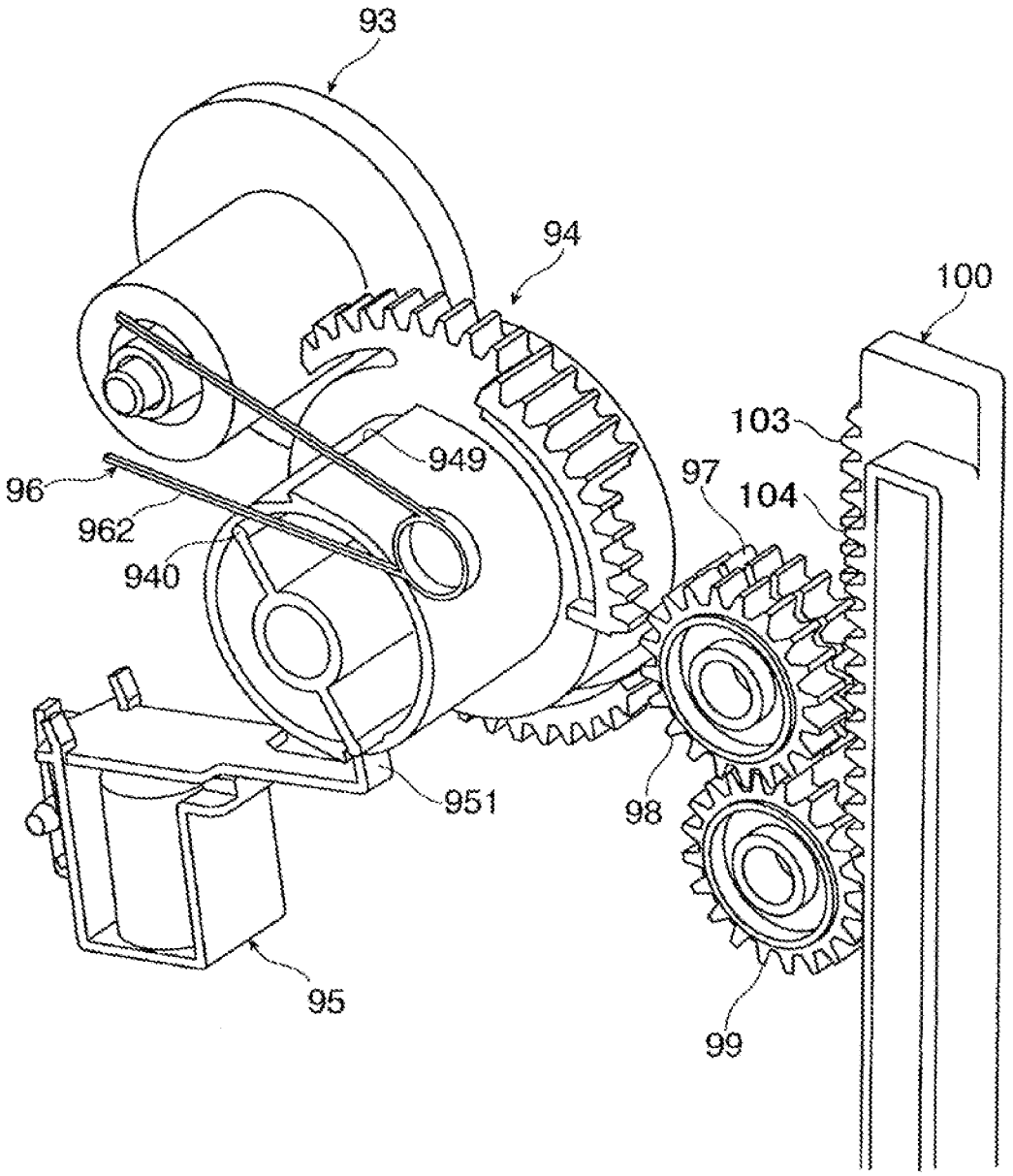
FIG. 21 is yet another perspective view of the drive switching device and illustrates the operation thereof.

Referring to FIG. 20, when the actuating plate 100 is moved upward by a specific length, the second rack 104 goes out of mesh with the reversal gear 99, whereby the actuating plate 100 stops moving. Meanwhile, when the upstream tier 945*a* of the second toothed part 945 of the partially toothless gear 94 goes out of mesh with the second switching gear 98, the partially toothless gear 94 is disengaged from the second switching gear 98. Then, the first toothed part 944 of the partially toothless gear 94 goes out of mesh with the driving gear 93. Subsequently, referring to FIG. 21, the actuating part 940 of the partially toothless gear 94 is pushed by the elastic force exerted by the first linear part 962 of the torsion spring 96 and is rotated counterclockwise in FIG. 21. Accordingly, the hook 951 of the solenoid 95 is caught by one of the locking parts 949, whereby the partially toothless gear 94 stops rotating. In this state, referring to FIG. 22, the first switching gear 97 is in mesh with the first rack 103 of the actuating plate 100.

Subsequently, the control device 200 drives the photoconductor drums 11 and the developing devices 14 by driving the first driving motor 52 and the second driving motor 53 to rotate, and starts a full-color image forming operation.

When the control device 200 has recognized that the image forming operation in the full-color mode has ended, referring now to FIG. 17, the control device 200 activates the third driving motor 54 and turns on the solenoid 95. Then, the hook 951 of the solenoid 95 is disengaged from the locking part 949 of the partially toothless gear 94, and the actuating part 940 of the partially toothless gear 94 is pushed by the elastic force exerted by the first linear part 962 of the torsion spring 96, whereby the partially toothless gear 94 is rotated (actuated) counterclockwise in FIG. 22.

Figure 22:
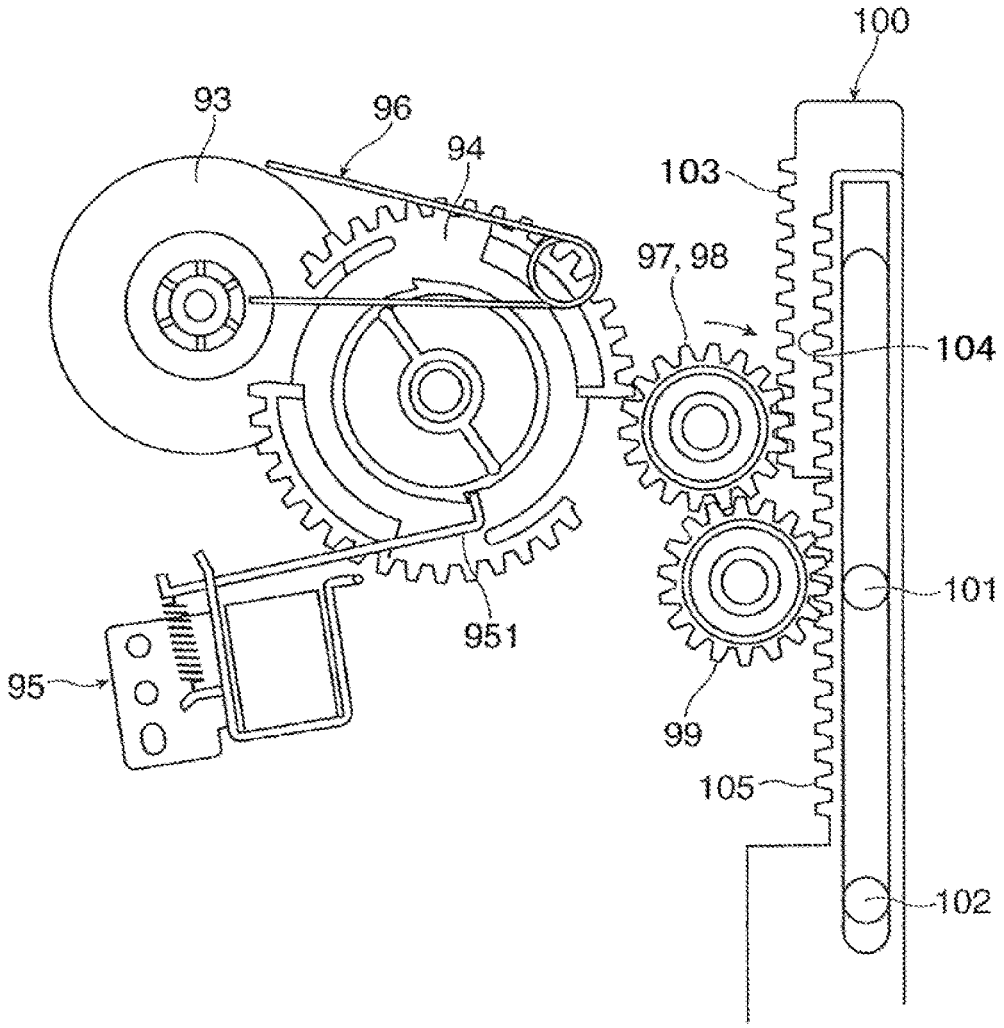
FIG. 22 is yet another perspective view of the drive switching device and illustrates the operation thereof.

When the partially toothless gear 94 is rotated counterclockwise in FIG. 22, the upstream end 945*a*' of the second toothed part 945 comes into mesh with the driving gear 93 that is driven to rotate by the third driving motor 54.

After the second toothed part 945 of the partially toothless gear 94 stably goes into mesh (by about three teeth) with the driving gear 93, referring to FIG. 22, the first toothed part 944 comes into mesh with the first switching gear 97 and causes the first switching gear 97 to rotate clockwise in FIG. 22. The rotational driving force exerted by the first switching gear 97 is transmitted to the first rack 103 of the actuating plate 100 and moves the actuating plate 100 downward.

With the downward movement of the actuating plate 100, the link member 72 of the photoconductor coupling mechanism 63 and the link member 84 of the developing-device coupling mechanism 82 that are in the first recess 106 and the second recess 107, respectively, of the actuating plate 100 are rotated. In the photoconductor coupling mechanism 63, the lever 721 of the link member 72 is rotated downward. Accordingly, referring to FIGS. 10A to 10C, the coupling member 71 is pushed toward the transmission gear 62, and the second projection 714 of the coupling member 71 goes out of the second recess 591 of the driving gear 59. Consequently, the rotational driving force of the driving gear 59 exerted when the driving gear 59 is driven is not transmitted to the transmission gear 62. Hence, only the black photoconductor drum 11K is rotated.

Meanwhile, in the developing-device coupling mechanism 82, the lever 841 of the link member 84 is rotated downward. Accordingly, referring to FIG. 13, the coupling member 83 is moved away from the driving gear 86 and the transmission gear 87, and the projections 832 of the coupling member 83 go out of the recesses 871 of the transmission gear 87. Consequently, the rotational driving force exerted by the driving gear 86 is not transmitted to the transmission gear 87, and the color developing devices 14 (Y, M, and C) are stopped. Hence, only the black developing device 14K is rotated.

Furthermore, with the downward movement of the actuating plate 100, the driving gear 110 that is in mesh with the third rack 105 of the actuating plate 100 is rotated, and the eccentric cams 322 and 323 are rotated counterclockwise in FIG. 7. Accordingly, the first surface-defining roller 24 and the color first transfer rollers 15 (Y, M, and C) are moved upward to the respective retracted positions, so that the color first transfer rollers 15 (Y, M, and C) and the intermediate transfer belt 21 are spaced apart from the photoconductor drums 11 (Y, M, and C).

Referring to FIG. 14, when the actuating plate 100 is moved upward by a specific length, the first rack 103 goes out of mesh with the first switching gear 97, whereby the actuating plate 100 stops moving with the second rack 104 thereof being in mesh with the reversal gear 99.

In this process, when the first surface-defining roller 24 and the color first transfer rollers 15 (Y, M, and C) are moved upward to the respective retracted positions, the tension applying roller 23 is moved outward in the longitudinal direction by the length $\Delta\alpha$ as described above and as illustrated in FIG. 23, so as to maintain the tension applied to the intermediate transfer belt 21 to a constant level. When the tension applying roller 23 is moved outward in the longitudinal direction of the intermediate transfer unit 300, the tension applying roller 23 slightly rotates counterclockwise in FIG. 23. With the rotation of the tension applying roller 23, the intermediate transfer belt 21 provided round the tension applying roller 23 is rotated in the reverse direction.

In the present exemplary embodiment, the control device 200 controls the driving device 50 such that the intermediate transfer belt 21 is driven to rotate in the normal direction at a speed V2 that is higher than or equal to a speed V1 of reverse rotation of the intermediate transfer belt 21 that occurs with the movement of the tension applying roller 23 at the changing of the mode from the full-color mode to the monochrome mode.

More specifically, referring to FIG. 17, when the mode is changed from the full-color mode to the monochrome mode, the control device 200 rotates the third driving motor 54, serving as a fuser motor, and thus moves the actuating plate 100 downward, thereby rotating the driving gear 110 that is in mesh with the third rack 105 of the actuating plate 100. Then, the driving shaft 316 connected to the driving gear 110 with the coupling member 326 interposed therebetween is rotated, and the first and second arm members 308 and 309 are rotated, with the aid of the slide members 310 and 311, by the eccentric cams 322 and 323 attached to the driving shaft 316. Accordingly, the first surface-defining roller 24 rotatably attached to the second arm member 309 is moved to the retracted position. Therefore, the tension applying roller 23 is rotated counterclockwise, and the intermediate transfer belt 21 rotates in the reverse direction.

To address such a situation, in the present exemplary embodiment, the control device 200 rotates the second driving motor 53 synchronously with the rotation of the third driving motor 54 and thus rotates the intermediate transfer belt 21 in the normal direction at the speed V2. Specifically, in the image forming apparatus 1 according to the present exemplary embodiment, the length $\Delta\alpha$ by which the tension applying roller 23 is moved when the mode is changed from the full-color mode to the monochrome mode is about 0.7 mm, and the speed V1 of reverse rotation of the intermediate transfer belt 21 is about 0.69 mm/s. Hence, in the image forming apparatus 1, while the mode is being changed from the full-color mode to the monochrome mode, the intermediate transfer belt 21 is rotated in the normal direction at the speed V2 that is higher than the speed V1.

Thus, according to the above exemplary embodiment, when the mode is changed from the full-color mode to the monochrome mode, the intermediate transfer belt 21 is prevented from rotating in the reverse direction. Therefore, referring to FIG. 24A, the cleaning plate 271 of the belt cleaning device 27 is maintained to be in contact with the intermediate transfer belt 21 while being constantly bent toward the leading side in the direction of normal rotation of the intermediate transfer belt 21. In such a configuration, the probability that the cleaning plate 271 of the belt cleaning device 27 may be damaged is lower than that in a case where a roller that is in contact with a contact member with a belt interposed therebetween is rotated in the reverse direction when the image forming mode is changed.

Then, the control device 200 rotates the first driving motor 52 and the second driving motor 53 so as to drive the photoconductor drum 11K and the developing device 14K for black (K), and starts a monochrome image forming operation.

While the above exemplary embodiment concerns a case where the contact member is the cleaning plate 271 of the belt cleaning device 27, the contact member may be any other member as long as the contact member may be damaged by the reverse rotation of the roller that occurs when the image forming mode is changed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an endless belt that is stretched around a plurality of rollers;

a driving unit that drives the belt to rotate;

a contact member that is in contact with a surface of the belt at a location where the surface is supported by a first roller of the plurality of rollers; and a switching device that changes an image forming mode by displacing at least one of the plurality of rollers, wherein, when the image forming mode is changed by the switching device, the belt is rotated by the driving unit in a normal direction at a speed higher than or equal to a speed of reverse rotation of the first roller that is in contact with the contact member with the belt interposed therebetween.

2. The image forming apparatus according to claim 1, wherein the first roller is a tension applying roller, and the contact member is in contact with the belt at a position where the tension applying roller is provided.

3. The image forming apparatus according to claim 1, wherein the image forming mode of the image forming apparatus includes a full-color mode and a monochrome mode, and wherein, when an image forming operation in the full-color mode ends, the switching device changes the image forming mode to the monochrome mode.

4. The image forming apparatus according to claim 3, wherein, when the image forming mode is changed from the full-color mode to the monochrome mode, one of the rollers that is provided next to the tension applying roller on a downstream side in a direction of rotation of the belt is moved to a retracted position.

5. The image forming apparatus according to claim 1, wherein the contact member is a cleaning member.

6. The image forming apparatus according to claim 3, further comprising a plurality of first transfer rollers, wherein one of the first transfer rollers transfers a black toner image, a distance of the one of the first transfer rollers to the contact member along a circumference of the endless belt being greater than relative distances of the other first transfer rollers to the contact member.

* * * * *